US009738092B2

(12) United States Patent
Takahashi et al.

(10) Patent No.: US 9,738,092 B2
(45) Date of Patent: Aug. 22, 2017

(54) IMAGE RECORDING APPARATUS AND RECORDING HEAD DRIVING METHOD

(71) Applicants: Hiroki Takahashi, Kanagawa (JP); Takeo Shirato, Kanagawa (JP)

(72) Inventors: Hiroki Takahashi, Kanagawa (JP); Takeo Shirato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/044,618

(22) Filed: Feb. 16, 2016

(65) Prior Publication Data

US 2016/0236466 A1 Aug. 18, 2016

(30) Foreign Application Priority Data

Feb. 17, 2015 (JP) ..... 2015-028760
Sep. 25, 2015 (JP) ..... 2015-188638
Feb. 15, 2016 (JP) ..... 2016-025735

(51) Int. Cl.
*B41J 2/045* (2006.01)
*B41J 2/36* (2006.01)
*B41J 2/155* (2006.01)

(52) U.S. Cl.
CPC ..... *B41J 2/362* (2013.01); *B41J 2/0452* (2013.01); *B41J 2/04515* (2013.01); *B41J 2/04573* (2013.01); *B41J 2/04581* (2013.01); *B41J 2/04588* (2013.01); *B41J 2/155* (2013.01)

(58) Field of Classification Search
CPC .... B41J 2/362; B41J 2/04588; B41J 2/04515; B41J 2/155; B41J 2/04581; B41J 2/0452; B41J 2/04573
See application file for complete search history.

(56) References Cited

U.S. PATENT DOCUMENTS 9,132,628 B2 9/2015 Shirato
2001/0024583 A1* 9/2001 Kawatoko ..... B41J 2/04508 400/74
2014/0253620 A1 9/2014 Watanabe et al.

FOREIGN PATENT DOCUMENTS

JP 2013-199025 10/2013
JP 2013-199025 A * 10/2013 ..... B41J 2/01
JP 2014-200951 10/2014

* cited by examiner

*Primary Examiner* — Manish S Shah
*Assistant Examiner* — Yaovi M Ameh
(74) *Attorney, Agent, or Firm* — Harness, Dickey & Pierce P.L.C.

(57) ABSTRACT

An image recording apparatus includes: a plurality of recording heads driven on a basis of drive waveform data; a data storage that retains parameter sets corresponding to the respective recording heads; a simultaneously driven nozzle count detector that detects, for each of the recording heads, a simultaneously driven nozzle count that represents a count of nozzles to be driven at an identical drive timing based on image data to be recorded on a recording medium; a correction parameter selector that selects, for each of the recording heads, a correction parameter corresponding to the detected simultaneously driven nozzle count from among a plurality of correction parameters included in the parameter set corresponding to the recording head; and a drive waveform data generator that corrects reference waveform data using the correction parameter selected for each of the recording heads and generates the drive waveform data for each of the recording heads.

17 Claims, 20 Drawing Sheets

| SIMULTANEOUSLY DRIVEN NOZZLE COUNT X | | 1≤X≤n1 | | | n1<X≤n2 | | | n2<X≤n3 | | |
|---|---|---|---|---|---|---|---|---|---|---|
| TEMPERATURE T | | T1 | T2 | T3 | T1 | T2 | T3 | T1 | T2 | T3 |
| PARAMETER SET | Y1 | 1.15 | 1.2 | 1.25 | 1.45 | 1.5 | 1.55 | 1.05 | 1.1 | 1.15 |
| | Y2 | 1.25 | 1.3 | 1.35 | 1.55 | 1.6 | 1.65 | 1.15 | 1.2 | 1.25 |
| | Y3 | 1.35 | 1.4 | 1.45 | 1.65 | 1.7 | 1.75 | 1.25 | 1.3 | 1.35 |
| | Y4 | 1.45 | 1.5 | 1.55 | 1.75 | 1.8 | 1.85 | 1.35 | 1.4 | 1.45 |
| | Y5 | 1.55 | 1.6 | 1.65 | 1.85 | 1.9 | 1.95 | 1.45 | 1.5 | 1.55 |
| | ⋮ | ⋮ | ⋮ | ⋮ | ⋮ | ⋮ | ⋮ | ⋮ | ⋮ | ⋮ |

| SIMULTANEOUSLY DRIVEN NOZZLE COUNT X | | 1≤X≤n1 | | | n1<X≤n2 | | | n2<X≤n3 | | |
|---|---|---|---|---|---|---|---|---|---|---|
| TEMPERATURE T | | T1 | T2 | T3 | T1 | T2 | T3 | T1 | T2 | T3 |
| PARAMETER SET | Y1 | 0.60 | 0.65 | 0.70 | 0.70 | 0.75 | 0.80 | 0.50 | 0.55 | 0.60 |
| | Y2 | 0.65 | 0.70 | 0.75 | 0.75 | 0.80 | 0.85 | 0.55 | 0.60 | 0.65 |
| | Y3 | 0.70 | 0.75 | 0.80 | 0.80 | 0.85 | 0.90 | 0.60 | 0.65 | 0.70 |
| | Y4 | 0.75 | 0.80 | 0.85 | 0.85 | 0.90 | 0.95 | 0.65 | 0.70 | 0.75 |
| | Y5 | 0.80 | 0.85 | 0.90 | 0.90 | 0.95 | 1.00 | 0.70 | 0.75 | 0.80 |
| | ⋮ | ⋮ | ⋮ | ⋮ | ⋮ | ⋮ | ⋮ | ⋮ | ⋮ | ⋮ |

| | | AMPLITUDE VALUE $V_{Hx}$ [mV] | | | |
|---|---|---|---|---|---|
| | | $V_{H1}$ | $V_{H2}$ | $V_{H3}$ | ··· |
| PARAMETER SET | Y1 | 120 | 100 | 80 | ··· |
| | Y2 | 130 | 110 | 90 | ··· |
| | Y3 | 140 | 120 | 100 | ··· |
| | Y4 | 150 | 130 | 110 | ··· |
| | Y5 | 160 | 140 | 120 | ··· |
| | ⋮ | ⋮ | ⋮ | ⋮ | ··· |

| | | AMPLITUDE VALUE Vc |
|---|---|---|
| PIEZOELECTRIC ELEMENT | 53_1 | 100 mV |
| | 53_2 | 400 mV |
| | 53_3 | 300 mV |
| | ⋮ | ⋮ |
| | 53_n | 100 mV |
| AVERAGE | | 200 mV |

IMAGE RECORDING APPARATUS AND RECORDING HEAD DRIVING METHOD

CROSS-REFERENCE TO RELATED APPLICATIONS

The present application claims priority to and incorporates by reference the entire contents of Japanese Patent Application No. 2015-028760 filed in Japan on Feb. 17, 2015, Japanese Patent Application No. 2015-188638 filed in Japan on Sep. 25, 2015, and Japanese Patent Application No. 2016-025735 filed in Japan on Feb. 15, 2016.

BACKGROUND OF THE INVENTION

1. Field of the Invention

The present invention relates to an image recording apparatus and a recording head driving method.

2. Description of the Related Art

An image recording apparatus such as an inkjet recording apparatus selectively drives a pressure generator (e.g., a piezoelectric element) provided for each nozzle of a recording head according to image data to thereby cause the nozzle to eject ink, so that an image is recorded on a recording medium such as paper. A known method for driving the recording head that includes the piezoelectric element as the pressure generator is to apply voltage with a common drive waveform to the piezoelectric element associated with each nozzle.

The recording head included in such an image recording apparatus develops unsteady ejection characteristics (e.g., an ink ejection velocity) as affected by the number of nozzles driven at an identical driving timing (hereinafter referred to as a "simultaneously driven nozzle count"), resulting in degraded image quality. A technique has thus been developed to prevent the image quality from being degraded. This technique detects the simultaneously driven nozzle count using the image data and corrects the drive waveform according to the detected simultaneously driven nozzle count, thereby stabilizing the ejection characteristics of the recording head.

Japanese Laid-open Patent Publication No. 2013-199025, for example, discloses a technique that detects the simultaneously driven nozzle count and a nozzle density, calculates a correction value corresponding to the detected simultaneously driven nozzle count and nozzle density, and corrects the drive waveform on the basis of the correction value. Japanese Laid-open Patent Publication No. 2014-200951 discloses another technique that generates in advance a correction value for each of different simultaneously driven nozzle counts, stores the correction values in a data storage, and acquires a correction value corresponding to a detected simultaneously driven nozzle count from the data storage to thereby correct the drive waveform using the correction value.

Each recording head, however, has unique ejection characteristics arising from errors in manufacturing processes, including, for example, variations in capacitance of the piezoelectric element and variations in the size of the nozzle. To record an image on a recording medium using a plurality of recording heads, therefore, simply correcting the drive waveform for driving each recording head uniformly with a correction value corresponding to the simultaneously driven nozzle count does not absorb differences in the ejection characteristics of the recording heads. Degradation of the image quality thus cannot be sufficiently prevented.

SUMMARY OF THE INVENTION

It is an object of the present invention to at least partially solve the problems in the conventional technology.

According to exemplary embodiments of the present invention, there is provided an image recording apparatus comprising: a plurality of recording heads driven on a basis of drive waveform data; a data storage that retains parameter sets corresponding to the respective recording heads; a simultaneously driven nozzle count detector that detects, for each of the recording heads, a simultaneously driven nozzle count that represents a count of nozzles to be driven at an identical drive timing based on image data to be recorded on a recording medium; a correction parameter selector that selects, for each of the recording heads, a correction parameter corresponding to the detected simultaneously driven nozzle count from among a plurality of correction parameters included in the parameter set corresponding to the recording head; and a drive waveform data generator that corrects reference waveform data using the correction parameter selected for each of the recording heads and generates the drive waveform data for each of the recording heads.

Exemplary embodiments of the present invention also provide a recording head driving method performed in an image recording apparatus that includes: a plurality of recording heads driven on a basis of drive waveform data; and a data storage that retains parameter sets corresponding to the respective recording heads, the recording head driving method comprising: detecting, for each of the recording heads, a simultaneously driven nozzle count that represents a count of nozzles to be driven at an identical drive timing based on image data to be recorded on a recording medium; selecting, for each of the recording heads, a correction parameter corresponding to the detected simultaneously driven nozzle count from among a plurality of correction parameters included in the parameter set corresponding to the recording head; and correcting reference waveform data using the correction parameter selected for each of the recording heads and generating the drive waveform data for each of the recording heads.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes in detail an image recording apparatus and a recording head driving method according to preferred embodiments of the present invention with reference to the accompanying drawings. The embodiments to be described hereunder are exemplified, as an image recording apparatus to which the present invention is applied, by an image recording apparatus having a configuration in which roll paper is a recording medium to record a full-color image. The applicable image recording apparatus is, however, illustrative only and not restrictive. Additionally, the exemplary image recording apparatus to be described hereunder includes a line type recording head array including a plurality of recording heads arrayed in a direction orthogonal to a conveyance direction of the recording medium to record an image on the recording medium. The applicable image recording apparatus is, however, illustrative only and not restrictive. The present invention is effectively applicable to a serial type image recording apparatus that includes a serial head in which a plurality of recording heads are mounted to record an image, as disclosed, for example, in FIG. 3 of Japanese Laid-open Patent Publication No. 2014-104716.

First Embodiment

Figure 1:
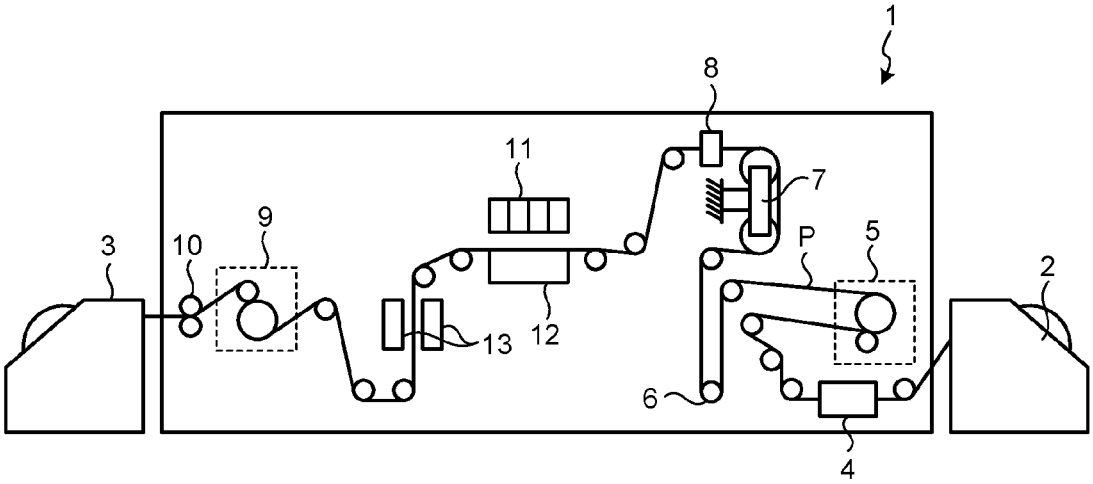
FIG. 1 is a schematic view of a general configuration of an image recording apparatus according to an embodiment of the present invention.

FIG. 1 is a schematic view of a general configuration of an image recording apparatus 1 according to a first embodiment. As illustrated in FIG. 1, the image recording apparatus 1 is disposed between a paper supply unit 2 and a paper recovery unit 3. The image recording apparatus 1 records a desired color image on roll paper (recording medium) P unwound at high speed from the paper supply unit 2. Roll paper P on which the image is recorded is taken up and recovered in sequence by the paper recovery unit 3.

The image recording apparatus 1 includes a conveyance unit for conveying the roll paper P. The conveyance unit includes a restricting guide 4, an infeed section 5, a dancer roller 6, an edge position control (EPC) 7, a skew amount detector 8, an outfeed section 9, and a puller 10. The restricting guide 4 performs positioning in a width direction of the roll paper P supplied from the paper supply unit 2. The infeed section 5 includes a drive roller and a driven roller. The infeed section 5 feeds the roll paper P unwound from the paper supply unit 2 toward a downstream side. The dancer roller 6 is configured so as to move up and down in response to tension in the roll paper P and outputs a position signal corresponding to the tension in the roll paper P. The EPC 7 controls skew in the roll paper P. The skew amount detector 8 detects a skew amount in the roll paper P for use in feedback control at the EPC 7. The outfeed section 9 includes a drive roller and a driven roller that rotate at a constant speed in order for the roll paper P to be conveyed at a set speed. The puller 10 includes a drive roller and a driven roller that eject the roll paper P out of the image recording apparatus 1.

The conveyance unit is configured as a tension controlling conveyance unit that controls rotation at the infeed section 5 according to the position signal output from the dancer roller 6 to thereby maintain a predetermined tension in the roll paper P being conveyed.

The image recording apparatus 1 further includes a recording head module 11, a platen 12, and driers 13. Specifically, the recording head module 11 is configured as a line head compatible with a full-color application. The platen 12 is disposed so as to be opposed to the recording head module 11. The recording head module 11 includes a line type recording head array that includes ink ejecting nozzles disposed along an entire width of a recording area. The recording head module 11 includes the recording head array for each color of black, cyan, magenta, and yellow. The recording head module 11 operates the recording head arrays of black, cyan, magenta, and yellow to record a full-color image.

The recording head array of each color is supported above the platen 12 such that a predetermined clearance is maintained between a nozzle surface and the platen 12. The recording head module 11 is capable of ejecting ink in time with a conveyance speed of the roll paper P, to thereby record a color image on the roll paper P. The driers 13 function to fix the ink ejected onto the roll paper P by the recording head module 11 in the roll paper P. The driers 13 illustrated in FIG. 1 are a non-contact type disposed slightly away from the roll paper P. Nonetheless, a contact type drier may be used instead.

Figure 2:
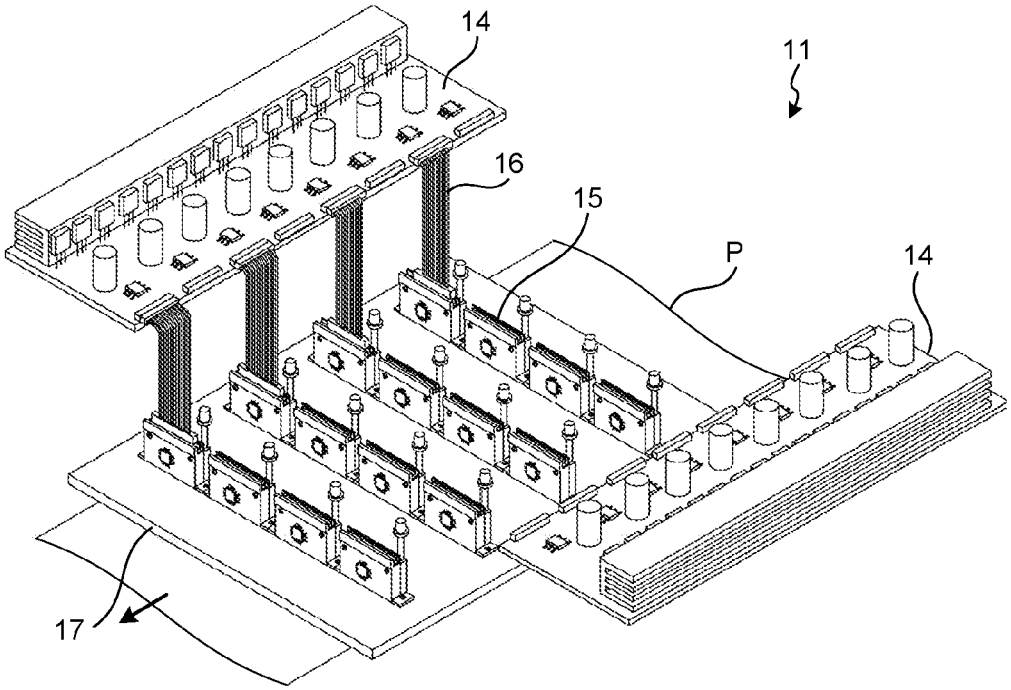
FIG. 2 is a perspective view of a general configuration of a recording head module of the image recording apparatus.
Figure 3:
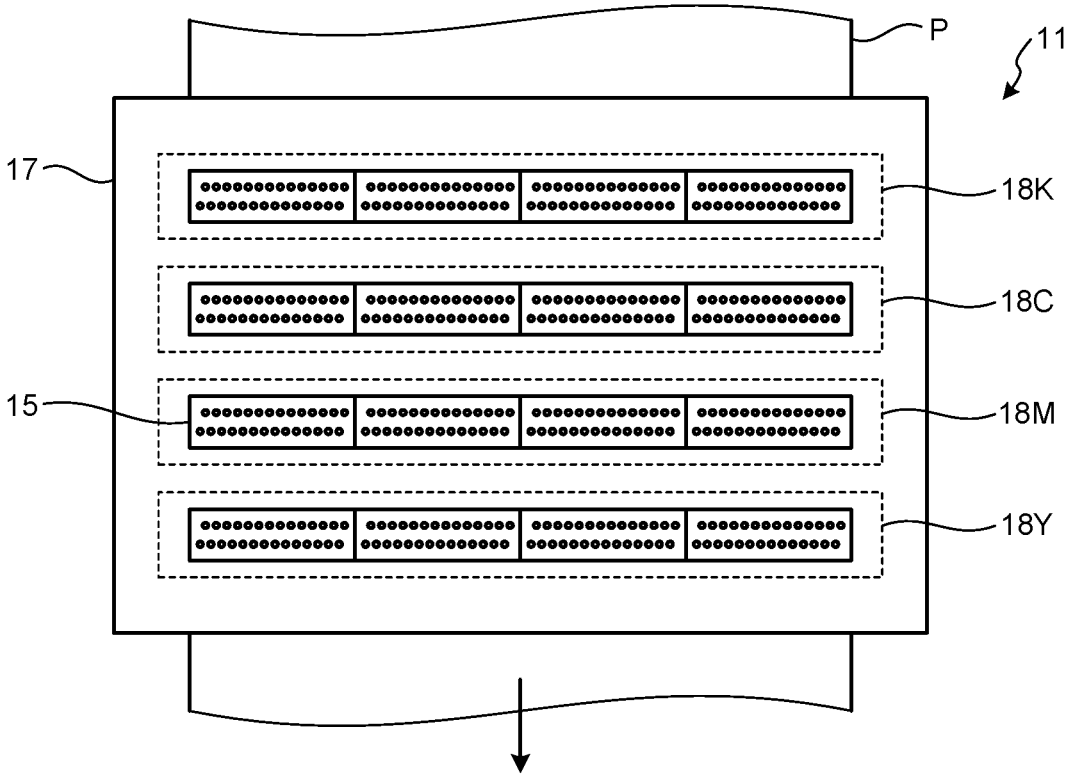
FIG. 3 is a diagram illustrating recording head arrays of the recording head module.
Figure 4:
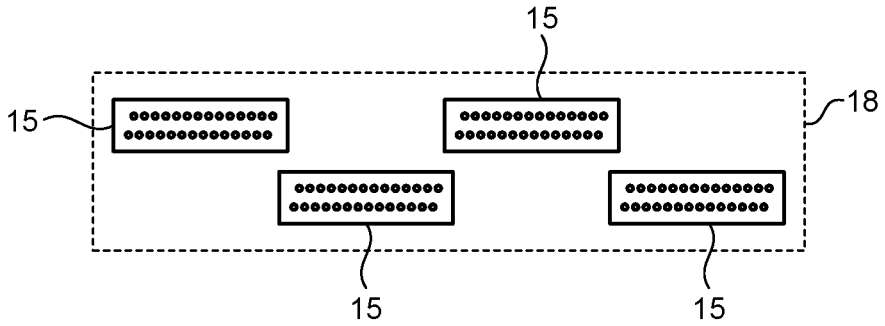
FIG. 4 is a diagram illustrating recording heads disposed in a zigzag pattern.
Figure 5:
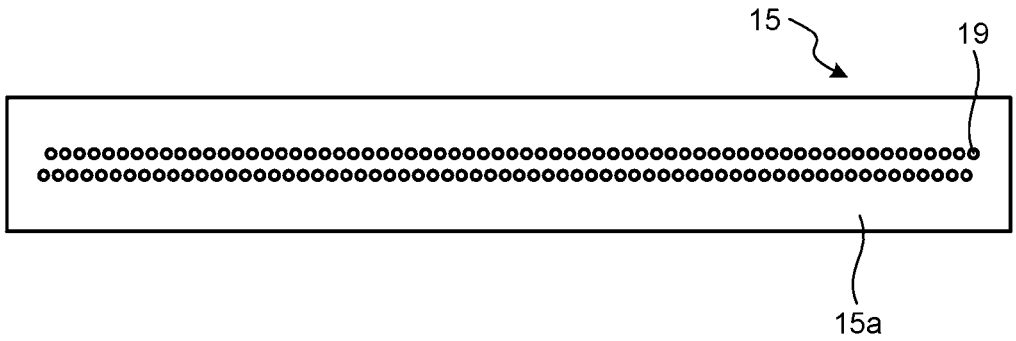
FIG. 5 is an enlarged plan view of nozzle surfaces of a recording head in the recording head module.
Figure 6:
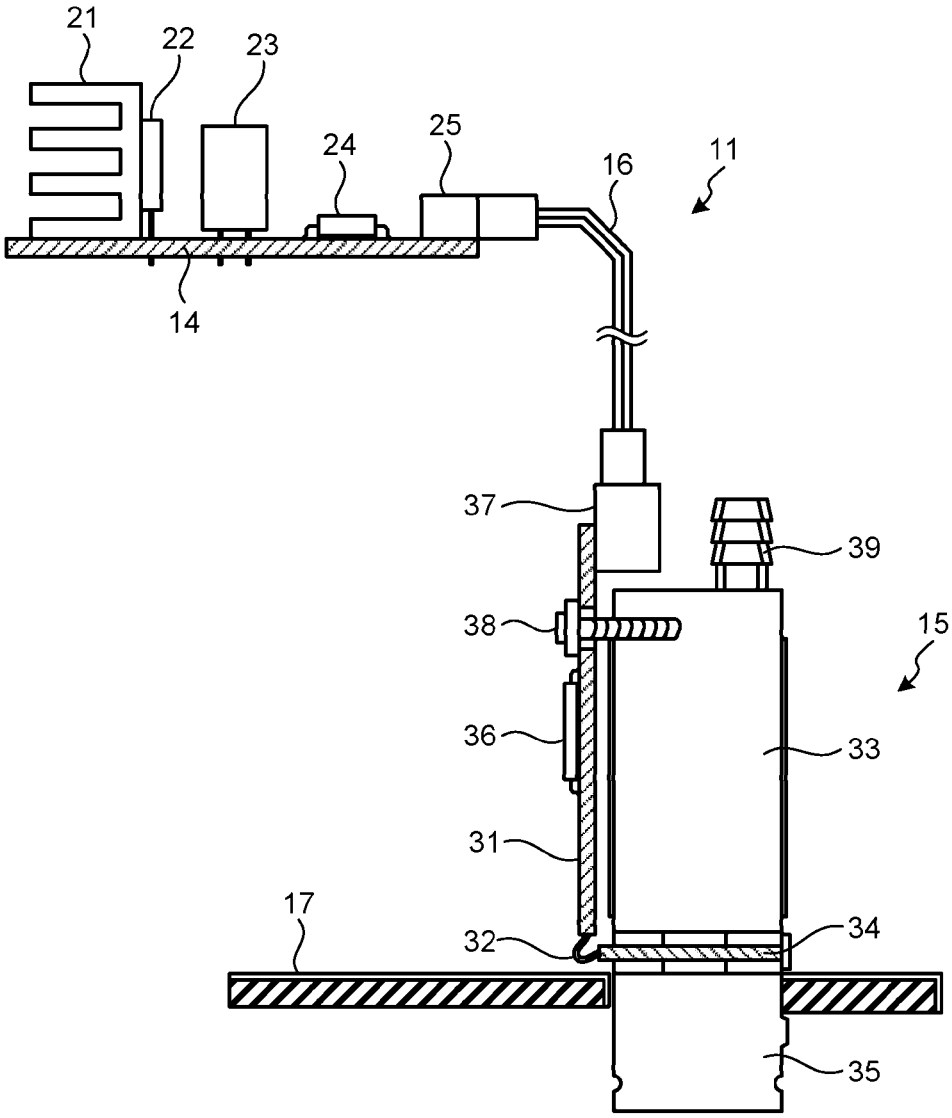
FIG. 6 is a diagram illustrating a condition in which the recording head is connected to a drive control board.
Figure 7:
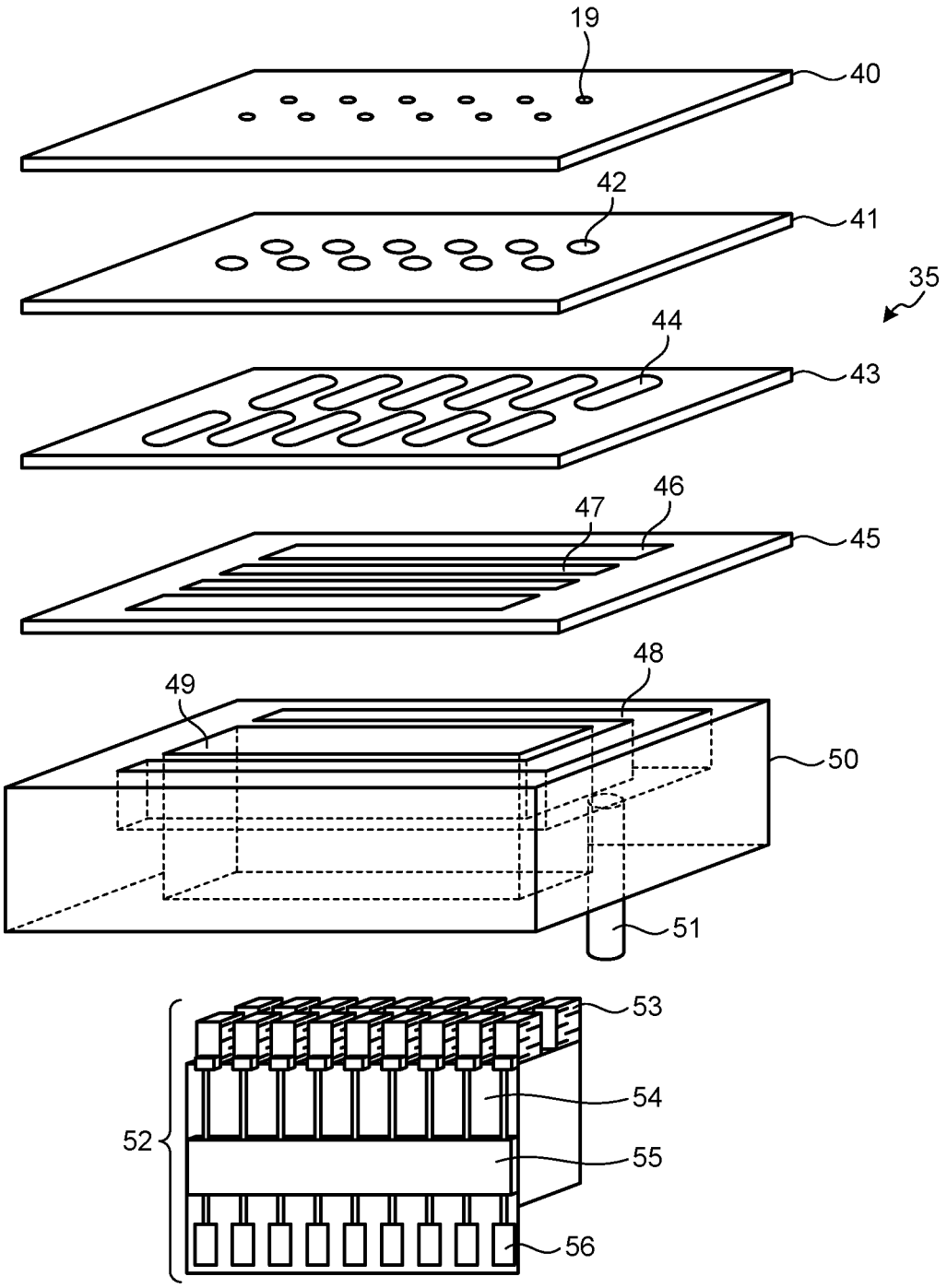
FIG. 7 is an exploded perspective view of a head section in the recording head.

The following describes in detail the recording head module 11 with reference to FIGS. 2 to 7. FIG. 2 is a perspective view of a general configuration of the recording head module 11. FIG. 3 is a diagram illustrating the recording head arrays. FIG. 4 is a diagram illustrating recording heads disposed in a zigzag pattern. FIG. 5 is an enlarged plan view of nozzle surfaces of a recording head. FIG. 6 is a diagram illustrating a condition in which the recording head is connected to a drive control board. FIG. 7 is an exploded perspective view of a head section in the recording head.

As illustrated in FIG. 2, the recording head module 11 includes drive control boards 14, recording heads 15, cables 16, and an adjust plate 17. The drive control boards 14 each are a rigid substrate on which are mounted circuits for generating a drive waveform for driving a piezoelectric element 53 (see FIG. 7) in the recording head 15 and for generating a gradation control signal for controlling application of the drive waveform according to image data. The cables 16 electrically connect the drive control boards 14 to the recording heads 15. The adjust plate 17 disposes and fixes the recording heads 15 highly accurately. The recording heads 15 each eject ink onto the roll paper P conveyed by the above-described conveyance unit on the platen 12 according to the drive waveform and the gradation control signal transmitted from the drive control board 14 via the cable 16.

The recording head module 11 illustrated in the first embodiment is configured such that a plurality of recording heads 15 are connected to and driven by a single drive control board 14. In the example illustrated in FIG. 2, a single drive control board 14 can drive to control a maximum of eight recording heads 15. In the example illustrated in FIG. 2, a total of 16 recording heads 15 are disposed on the adjust plate 17, so that the recording head module 11 includes two drive control boards 14. For ease of understanding, FIG. 2 illustrates only some of the recording heads 15 are connected to the drive control board 14 via the cables 16. In reality, however, all of the recording heads 15 are connected to the drive control boards 14 via the cables 16.

Reference is made to FIG. 3. To be compatible with full-color images, the recording head module 11 includes a recording head array 18K that ejects black ink, a recording head array 18C that ejects cyan ink, a recording head array 18M that ejects magenta ink, and a recording head array 18Y that ejects yellow ink. The recording head array 18K, the recording head array 18C, the recording head array 18M, and the recording head array 18Y will hereinafter be collectively referred to as a recording head array 18. Each recording head array 18 is configured as an assembly of a plurality of (four in the example illustrated in FIG. 3) recording heads 15 arrayed in a direction orthogonal to a conveyance direction of the roll paper P indicated by the arrow in FIG. 3. The recording heads 15 arrayed into the recording head array 18 achieve a wide recording area width without the need to enlarge the size of each individual recording head 15.

FIG. 3 illustrates the recording head array 18 that includes the recording heads 15 arrayed in the direction orthogonal to the conveyance direction of the roll paper P. Nonetheless, as illustrated in FIG. 4, the recording heads 15 may be arrayed in a zigzag pattern along the direction orthogonal to the conveyance direction of the roll paper P. The following description assumes that the recording head array 18 includes a plurality of recording heads 15 arrayed in a zigzag pattern.

As illustrated in FIG. 5, the recording head 15 includes a plurality of nozzles 19 that open on the side of a bottom surface 15*a* (that faces the platen 12) of the recording head 15. The bottom surface 15*a* serves as a nozzle surface. The recording head 15 illustrated in FIG. 5 includes two rows of the nozzles 19, each row including a total of 64 nozzles arrayed linearly. The nozzles 19 are arrayed in a zigzag pattern so that the nozzles 19 on a first nozzle row and the nozzles 19 on a second nozzle row alternate with each other. The arrangement of the nozzles 19 in a zigzag pattern achieves high resolution.

As illustrated in FIG. 6, for example, a cooling fin 21, a current amplifier 22, an electrolytic capacitor 23, a transmission-side field-programmable gate array (FPGA) 24, and a connector 25 are mounted on the drive control board 14. Additionally, a D/A converter (DAC) 26 and an operational amplifier 27 (see FIGS. 8 and 13) to be described later are also mounted on the drive control board 14. The cooling fin 21 cools Joule heat generated as loss of the current amplifier 22. The connector 25 receives the cable 16 that achieves electric connection with the recording head 15.

As will be described later, the drive control board 14 causes the DAC 26 to convert drive waveform data generated for each recording head 15 into a corresponding analog drive waveform (voltage waveform). The drive control board 14 then causes the operational amplifier 27 to amplify voltage and causes the current amplifier 22 to amplify current, thereby supplying a resultant drive waveform to a piezoelectric element 53 (see FIG. 7) of the recording head 15. The electrolytic capacitor 23 assists in the supply of current to the piezoelectric element 53. The transmission-side FPGA 24 serializes the gradation control signal generated according to the image data and transmits the resultant signal to the recording head 15.

As illustrated in FIG. 6, the recording head 15 includes an image data control board 31, a flexible printed wiring board 32, a head tank 33, a head board 34, and a head section 35.

The image data control board 31 is a rigid substrate on which are mounted a reception-side FPGA 36 and a connector 37 on which the cable 16 is mounted. The image data control board 31 is, for example, fixed to a side surface of the head tank 33 using a tapping screw 38. The reception-side FPGA 36 deserializes the gradation control signal transmitted serially from the transmission-side FPGA 24 on the drive control board 14 to thereby parallelly transmit the resultant signal to a piezoelectric element drive IC 55 (see FIG. 7) to be described later.

The flexible printed wiring board 32 electrically connects the image data control board 31 to the head board 34. The flexible printed wiring board 32 is formed of a flexible material and can be easily folded.

The head board 34 is a rigid substrate that includes a pad for connecting a piezoelectric element support board 54 (see FIG. 7) mounted in the head section 35. The piezoelectric element support board 54 will be described later. The head board 34 is disposed and bonded between the head section 35 and the head tank 33. The head section 35 is disposed at and fixed to the adjust plate 17. An internal configuration of the head section 35 will be described later with reference to FIG. 7.

The head tank 33 is a tank for temporarily reserving the ink to be ejected from the nozzles 19. The ink is supplied through a joint section 39 disposed on the head tank 33. A description and illustration of a configuration upstream of the joint section 39 will be omitted.

In the recording head module 11 exemplified in the first embodiment, the current amplifier 22, the cooling fin 21, and the like are mounted on the drive control board 14 that is separate from the recording head 15 and the image data control board 31 and the head board 34 as the rigid substrates are integrated with the flexible printed wiring board 32 (specifically, no connectors are mounted for connecting the boards). The recording head module 11 in the first embodiment thereby achieves the recording heads 15 that are built compactly.

The following describes a detailed internal configuration of the head section 35 of the recording head 15. The head section 35 includes a nozzle plate 40, a pressure chamber plate 41, a restrictor plate 43, a diaphragm plate 45, a rigid plate 50, and a piezoelectric element group 52.

The nozzles 19 are formed in the nozzle plate 40. The pressure chamber plate 41 has pressure chambers 42 corresponding to the respective nozzles 19. The restrictor plate 43 includes restrictors 44 that provide fluid communication between a common ink flow path 48 disposed in the rigid plate 50 and the pressure chambers 42 in the pressure chamber plate 41 to thereby control an ink flow rate to the pressure chambers 42. The diaphragm plate 45 includes a vibration plate 47 and filters 46. The nozzle plate 40, the pressure chamber plate 41, the restrictor plate 43, and the diaphragm plate 45 are, while being positioned correctly, stacked one on top of another and bonded to each other to constitute a flow path plate.

The rigid plate 50 has the common ink flow path 48 and an opening 49 that houses therein the piezoelectric element group 52. The rigid plate 50 further includes an ink guide pipe 51 for supplying ink in the head tank 33 to the common ink flow path 48. The above-described flow path plate is bonded to the rigid plate 50 so that the filters 46 included in the diaphragm plate 45 are opposed to the common ink flow path 48.

The piezoelectric element group 52 includes a plurality of piezoelectric elements 53 arrayed on the piezoelectric element support board 54. The piezoelectric element support board 54 includes an electrode pad 56 for connecting to the head board 34 illustrated in FIG. 6. The electrode pad 56 is connected through soldering to the head board 34 to thereby establish an electric connection. The piezoelectric element support board 54 further includes a piezoelectric element drive IC 55 mounted thereon. The piezoelectric element drive IC 55 applies a drive waveform to the piezoelectric element 53 according to the gradation control signal transmitted parallelly from the reception-side FPGA 36. The piezoelectric element group 52 is housed in the opening 49 in the rigid plate 50. Each of the piezoelectric elements 53 has a free end bonded and fixed to the vibration plate 47 of the diaphragm plate 45.

For ease of understanding, FIG. 7 illustrates reduced numbers of nozzles 19, pressure chambers 42, restrictors 44, piezoelectric elements 53, and the like. Additionally, ink ejection operations of the head section 35 are well-known and a detailed description therefor will be omitted.

The following describes in detail a circuit configuration and a correction technique for driving to control the recording head 15 according to the first embodiment in comparison with the known technology as a comparative example. In the following description to describe the first embodiment and the comparative example, like elements are identified by the same reference numerals.

Figure 8:
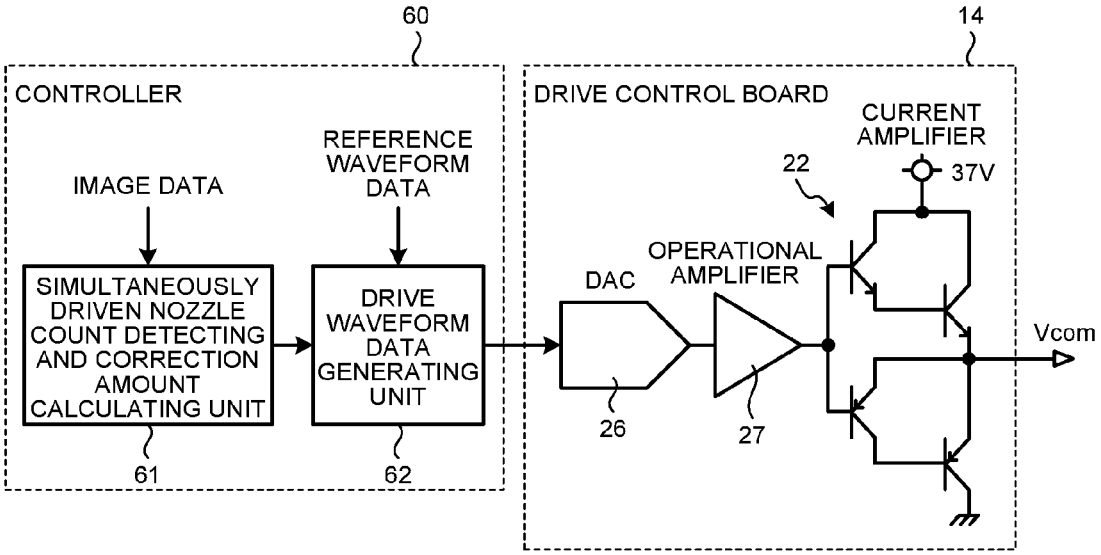
FIG. 8 is a block diagram illustrating a circuit configuration of a comparative example.

The following describes a circuit configuration and a correction technique of the comparative example. FIG. 8 is a block diagram illustrating the circuit configuration of the comparative example. As illustrated in FIG. 8, the circuit for driving to control a recording head 15 in the comparative example includes a simultaneously driven nozzle count detecting and correction amount calculating unit 61, a drive waveform data generating unit 62, a DAC 26, an operational amplifier 27, and a current amplifier 22. The DAC 26, the operational amplifier 27, and the current amplifier 22 are mounted on a drive control board 14 as described previously. The simultaneously driven nozzle count detecting and correction amount calculating unit 61 and the drive waveform data generating unit 62 are disposed, for example, in a controller 60 disposed in or connected to an apparatus main unit of an image recording apparatus 1.

The simultaneously driven nozzle count detecting and correction amount calculating unit 61 detects the number of simultaneously driven nozzles, specifically, the simultaneously driven nozzle count using image data. On the basis of the detected simultaneously driven nozzle count, the simultaneously driven nozzle count detecting and correction amount calculating unit 61 calculates a correction amount that corrects variations in an ink ejection velocity Vj and an ink mass Mj and passes the correction amount to the drive waveform data generating unit 62. As described above, the simultaneously driven nozzle count represents the number of nozzles driven at an identical driving timing. And, in embodiments of the present invention, there is a case where the driving timing is shifted according to variations in the circuit, such a case is also included within the scope of the identical driving timing.

The drive waveform data generating unit 62 corrects reference waveform data previously established as waveform data to serve as a reference using the correction amount calculated by the simultaneously driven nozzle count detecting and correction amount calculating unit 61, to thereby generate drive waveform data for driving the recording head 15. The drive waveform data generated by the drive waveform data generating unit 62 is transmitted from the controller 60 to the drive control board 14 and input to the DAC 26.

The DAC 26 coverts the input digital drive waveform data into a corresponding analog drive waveform (voltage waveform) and inputs the analog drive waveform to the operational amplifier 27. The operational amplifier 27 amplifies voltage of the input voltage waveform by a predetermined amplification factor and inputs the resultant waveform to the current amplifier 22. The current amplifier 22 is connected to the recording head 15 and a voltage/current drive waveform Vcom required for driving is supplied to a piezoelectric element 53 inside the recording head 15.

Figure 9:
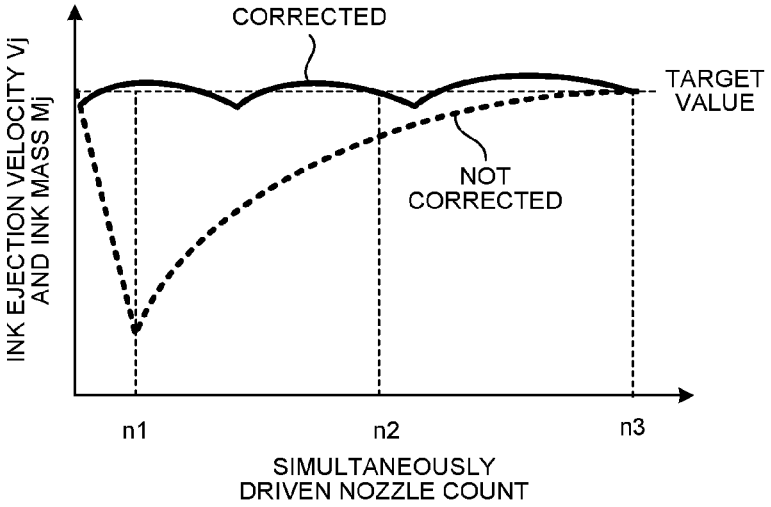
FIG. 9 is a diagram illustrating exemplary ejection characteristics of the recording head according to a simultaneously driven nozzle count.

FIG. 9 is a diagram illustrating exemplary ejection characteristics of the recording head 15 according to the simultaneously driven nozzle count. In FIG. 9, the abscissa denotes the simultaneously driven nozzle count and the ordinate denotes the ink ejection velocity Vj and the ink mass Mj as the ejection characteristics of the recording head 15. Additionally, in FIG. 9, the broken line indicates variations in the ejection characteristics of the recording head 15 when the drive waveform data is not corrected (the reference waveform data is directly made without correction to serve as the drive waveform data), and the solid line indicates variations in the ejection characteristics of the recording head 15 when the drive waveform data is corrected (the reference waveform data is corrected according to the simultaneously driven nozzle count to serve as the drive waveform data). A relation of n1<n2<n3 holds for the simultaneously driven nozzle counts n1, n2, and n3.

The common drive waveform Vcom is applied to the piezoelectric element 53 that is associated with each of the nozzles 19 of the recording head 15. Load (capacitance) of the drive waveform varies, at this time, according to the simultaneously driven nozzle count. When the drive waveform data is not corrected according to the simultaneously driven nozzle count, therefore, overshoot and undershoot occur in the drive waveform. As a result, the ink ejection velocity Vj and the ink mass Mj as the ejection characteristics of the recording head 15 vary greatly, as indicated by the broken line in FIG. 9, depending on the simultaneously driven nozzle count. In contrast, when the drive waveform data is corrected, a constant drive waveform is applied at all times to the piezoelectric element 53 even with varying simultaneously driven nozzle counts. Thus, as indicated by the solid line in FIG. 9, variations in the ink ejection velocity Vj and the ink mass Mj arising from the changes in the simultaneously driven nozzle count can be reduced and the ejection characteristics can be at all times stabilized at a level close to target values.

Figure 10A:
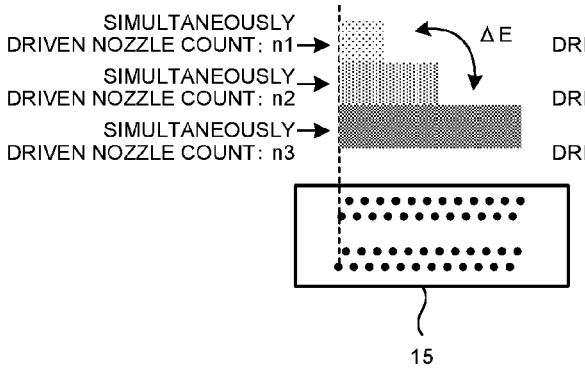
FIGS. 10A and 10B are diagrams illustrating effects achieved by correcting drive waveform data according to the simultaneously driven nozzle count.
Figure 10B:
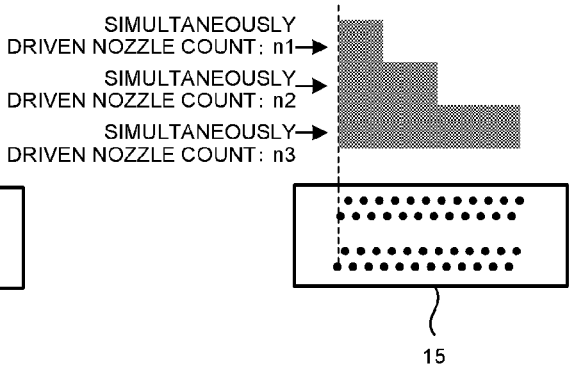

FIGS. 10A and 10B are diagrams illustrating effects achieved by correcting the drive waveform data according to the simultaneously driven nozzle count. FIGS. 10A and 10B illustrate changes in density of an image recorded when ink is ejected from the recording head 15 while the simultaneously driven nozzle count is varied in the order of n1, n2, n3. FIG. 10A illustrates changes in the density of the image when the drive waveform data is not corrected and FIG. 10B illustrates changes in the density of the image when the drive waveform data is corrected.

Assume that the recording head 15 has the ejection characteristics illustrated in FIG. 9. When the drive waveform data is not corrected according to the simultaneously driven nozzle count, the image recorded by driving n1 nozzles has a density lower than a density of the image recorded by driving n3 nozzles (a density difference ΔE occurs) as illustrated in FIG. 10A, because the ink ejection velocity Vj and the ink mass Mj are smaller with a simultaneously driven nozzle count of n1 than with a simultaneously driven nozzle count of n3. In contrast, when the drive waveform data is corrected according to the simultaneously driven nozzle count, variations in the ink ejection velocity Vj and the ink mass Mj arising from the change in the simultaneously driven nozzle count are reduced, so that the densities of the recorded images are equalized as illustrated in FIG. 10B.

As described above, the comparative example corrects the drive waveform data using the correction amount calculated according to the simultaneously driven nozzle count, to thereby reduce variations in the ejection characteristics of the recording head 15 arising from the change in the simultaneously driven nozzle count. The comparative example, however, does not take into consideration differences in the ejection characteristics among different recording heads 15. Thus, for a configuration in which the recording head arrays 18, each being configured as an assembly of a plurality of recording heads 15, incorporated in the image recording apparatus 1 of the first embodiment, are to record an image of one line, differences in the ejection characteristics among different recording heads 15 may not be properly absorbed and an uneven density may occur in the image for one line.

Figure 11A:
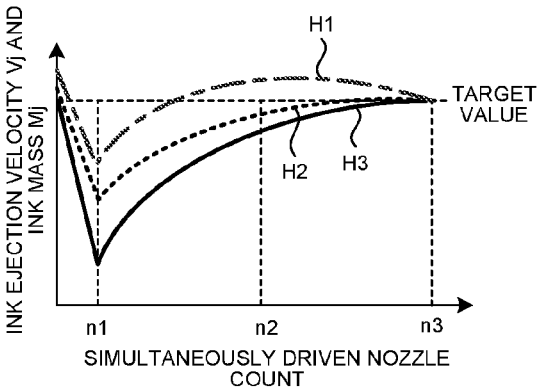
FIGS. 11A and 11B are diagrams illustrating differences in the ejection characteristics among different recording heads.
Figure 11B:
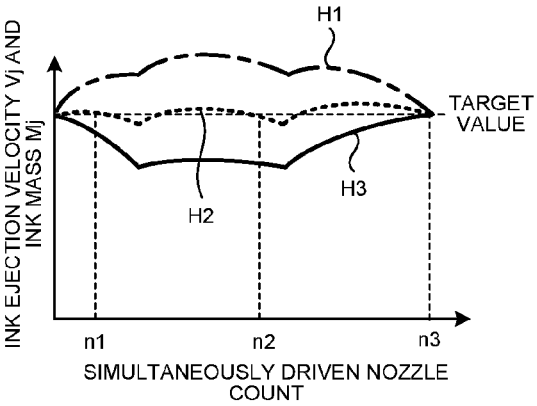

FIGS. 11A and 11B are diagrams illustrating differences in the ejection characteristics among the recording heads 15. As in FIG. 9, the abscissa in FIGS. 11A and 11B denotes the simultaneously driven nozzle count (n1<n2<n3) and the ordinate in FIGS. 11A and 11B denotes the ejection characteristics of the recording heads 15 (the ink ejection velocity Vj and the ink mass Mj). The graph illustrated in FIG. 11A represents variations in the ejection characteristics of three recording heads 15 (denoted in FIG. 11A as H1, H2, and H3) when the drive waveform data is not corrected. The graph illustrated in FIG. 11B represents variations in the ejection characteristics of each of the recording heads H1, H2, and H3 when the drive waveform data is corrected uniformly according to the simultaneously driven nozzle count to incorporate the ejection characteristics of the recording head H2 of FIG. 11A.

The recording head 15 has unique ejection characteristics arising from errors in the manufacturing processes, including, for example, variations in capacitance of the internal piezoelectric element 53 and variations in the size of the nozzle 19 formed in the nozzle plate 40. Specifically, as is known from the graph of FIG. 11A illustrating the variations in the ejection characteristics of each of the recording heads H1, H2, and H3, each of the recording heads H1, H2, and H3 has a unique ink ejection velocity Vj and a unique ink mass Mj even with the same simultaneously driven nozzle count. As a result, when the drive waveform data is corrected uniformly according to the simultaneously driven nozzle count for each of the recording heads H1, H2, and H3 using a correction amount calculated so as to incorporate, for example, the ejection characteristics of the recording head H2, the results are as illustrated in FIG. 11B. Specifically, while the ejection characteristics (the ink ejection velocity Vj and the ink mass Mj) of the recording head H2 can be stabilized at around the target value, the ejection characteristics of the recording head H1 are greater than the target value and the ejection characteristics of the recording head H3 are smaller than the target value.

Figure 12:
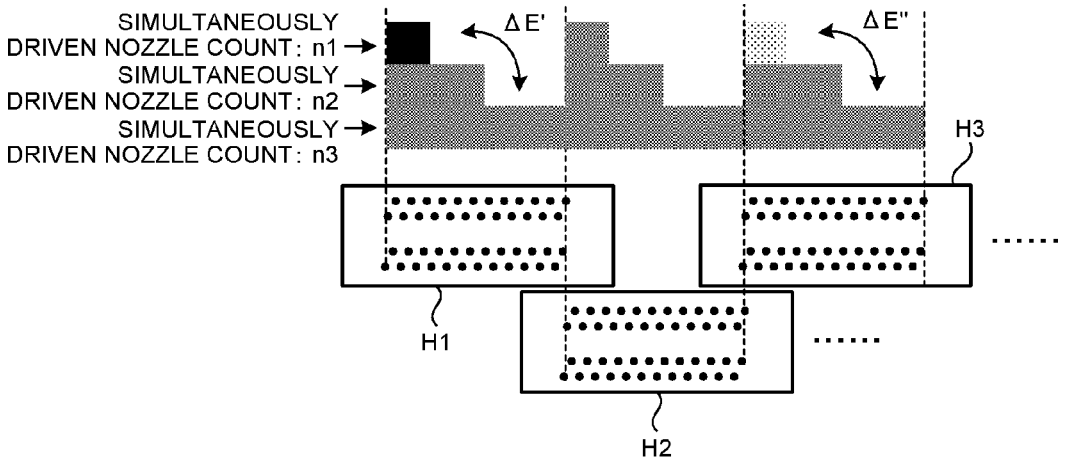
FIG. 12 is a diagram illustrating effects caused by differences in the ejection characteristics among the different recording heads that constitute the recording head array.

FIG. 12 is a diagram illustrating effects caused by differences in the ejection characteristics among the different recording heads 15 that constitute the recording head array 18. FIG. 12 is concerned with an exemplary configuration of the recording head array 18 that includes the three recording heads H1, H2, and H3 illustrated in FIGS. 11A and 11B arrayed in a zigzag pattern in a direction orthogonal to the conveyance direction of the roll paper P. FIG. 12 illustrates changes in the densities of images recorded when ink is ejected from each of the recording heads H1, H2, and H3 in a condition in which, as with FIGS. 10A and 10B, the drive waveform data is corrected to incorporate the ejection characteristics of the recording head H2 while the simultaneously driven nozzle count is varied in the order of n1, n2, n3.

As illustrated in FIG. 12, the image recorded by the recording head H2 exhibits a uniform image density because the correction of the drive waveform data stabilizes the ink ejection velocity Vj and the ink mass Mj at around the target value even with varying simultaneously driven nozzle counts. In contrast, the image recorded by the recording head H1 exhibits a higher image density (a density difference ΔE' is produced) than with a simultaneously driven nozzle count of n3, because the ink ejection velocity Vj and the ink mass Mj are greater than the target value with a simultaneously driven nozzle count of n1. The image recorded by the recording head H3 exhibits a lower image density (a density difference ΔE" is produced) than with a simultaneously driven nozzle count of n3, because the ink ejection velocity Vj and the ink mass Mj are smaller than the target value with a simultaneously driven nozzle count of n1. Thus, the recording of images using the recording head array 18 that includes these three recording heads H1, H2, and H3 results in degraded image quality due to the uneven densities in the recorded images. While the above describes a case of the three recording heads H1, H2, and H3, such uneven image densities can occur for each recording head 15 that constitutes the recording head array 18.

Figure 13:
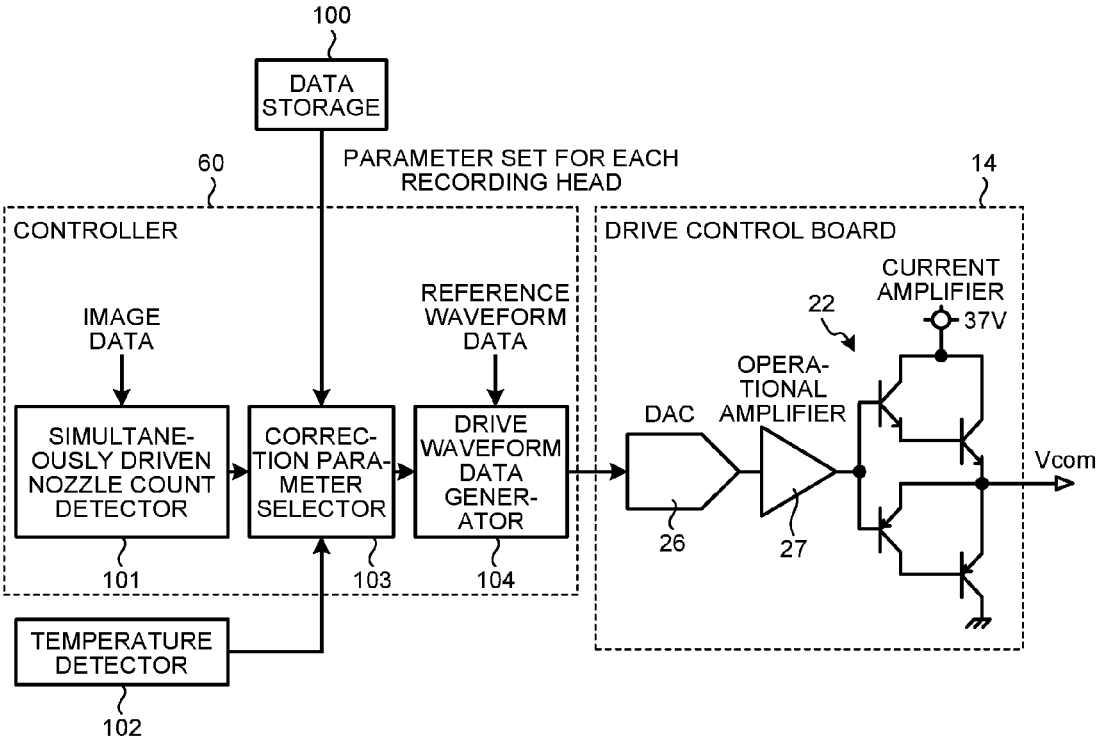
FIG. 13 is a block diagram illustrating a circuit configuration of the first embodiment.

The following describes the circuit configuration and the correction technique of the first embodiment. FIG. 13 is a block diagram illustrating the circuit configuration of the first embodiment. The circuit in the first embodiment for driving to control the recording heads 15 includes, as illustrated in FIG. 13, a data storage 100, a simultaneously driven nozzle count detector 101, a temperature detector 102, a correction parameter selector 103, a drive waveform data generator 104, the DAC 26, the operational amplifier 27, and the current amplifier 22. The DAC 26, the operational amplifier 27, and the current amplifier 22 are mounted on the drive control board 14 as described previously. The simultaneously driven nozzle count detector 101, the correction parameter selector 103, and the drive waveform data generator 104 are disposed, for example, in the controller 60 disposed in or connected to the apparatus main unit of the image recording apparatus 1. Another configuration may be possible in which the simultaneously driven nozzle count detector 101, the correction parameter selector 103, and the drive waveform data generator 104 are achieved by, for example, an application specific integrated circuit (ASIC) or an FPGA mounted on the drive control board 14.

The data storage 100 is a non-volatile memory that retains a parameter set associated with each of the recording heads 15 of the image recording apparatus 1 in the first embodiment. The parameter set includes a plurality of correction parameters for correcting the reference waveform data to thereby generate the drive waveform data. Each of the correction parameters included in the parameter set has a value established according to the simultaneously driven nozzle count and temperature. The correction parameter may be a correction factor or a correction amount with respect to the reference waveform data. The following description assumes that the correction parameter is the correction factor with respect to the reference waveform data. In addition, the following illustrates a case in which a voltage value of the reference waveform data is subjected to correction and a case in which a rise time and a fall time of the reference waveform data are subjected to correction. Nonetheless, a configuration is also possible in which the voltage value of the reference waveform data and the rise time and the fall time of the reference waveform data are subjected simultaneously to correction.

Figures 14, 15:
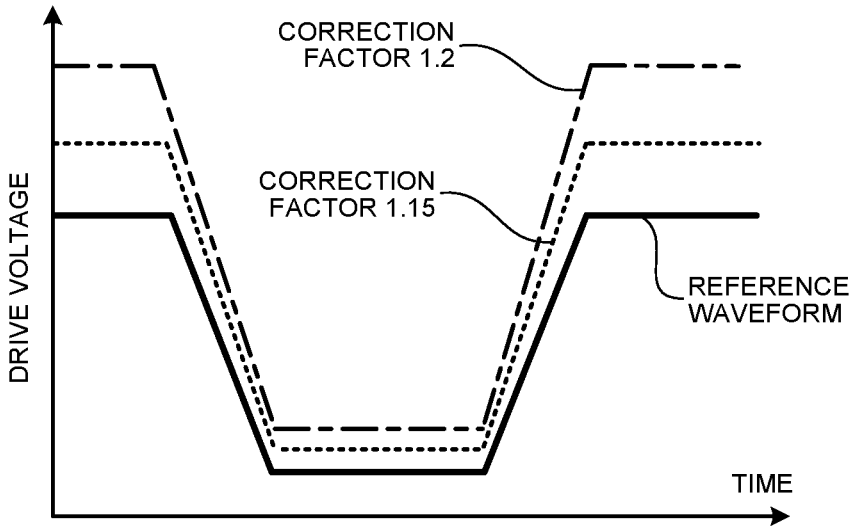
FIG. 14 is a table illustrating exemplary parameter sets applicable when a voltage value of reference waveform data is subjected to correction.
FIG. 15 is a graph illustrating exemplary drive waveforms when the voltage value of the reference waveform data is corrected using the parameter sets illustrated in FIG. 14.

FIG. 14 is a table illustrating exemplary parameter sets applicable when the voltage value of the reference waveform data is subjected to correction. A parameter set Y1, for example, illustrated in FIG. 14 indicates that, when a simultaneously driven nozzle count X is $1 \leq X \leq n1$, the correction factor is 1.15 with a temperature T of T1, the correction factor is 1.2 with the temperature T of T2, and the correction factor is 1.25 with the temperature T of T3. The parameter set Y1 further indicates that, when the simultaneously driven nozzle count X is $n1 < X \leq n2$, the correction factor is 1.45 with the temperature T of T1, the correction factor is 1.5 with the temperature T of T2, and the correction factor is 1.55 with the temperature T of T3. The parameter set Y1 further indicates that, when the simultaneously driven nozzle count X is $n2 < X \leq n3$, the correction factor is 1.05 with the temperature T of T1, the correction factor is 1.1 with the temperature T of T2, and the correction factor is 1.15 with the temperature T of T3. Thus, the parameter set represents a set of correction factors (correction parameters) established according to the simultaneously driven nozzle count X and the temperature T. It is noted that, in FIG. 14, a relation of $n1 < n2 < n3$ holds for variables n1, n2, and n3 of the simultaneously driven nozzle count X, and a relation of $T1 < T2 < T3$ holds for variables T1, T2, and T3 of the temperature T.

FIG. 15 is a graph illustrating exemplary drive waveforms when the voltage value of the reference waveform data is corrected using the parameter sets illustrated in FIG. 14. In FIG. 15, the waveform indicated by the solid line represents a reference waveform corresponding to the reference waveform data before the correction (specifically, the correction factor of 1.0), the waveform indicated by the broken line represents a reference waveform corresponding to the reference waveform data having the voltage value corrected by a correction factor of 1.15, and the waveform indicated by the dash-single-dot line represents a reference waveform corresponding to the reference waveform data having the voltage value corrected by a correction factor of 1.2. The configuration of subjecting the voltage value of the reference waveform data to correction, as in the example of FIG. 15, does not depend on performance of, for example, a response speed of the DAC 26 or the operational amplifier 27 mounted on the drive control board 14. This feature achieves a simplified circuit configuration, offering an advantage of reduced apparatus cost.

Figures 16, 17:
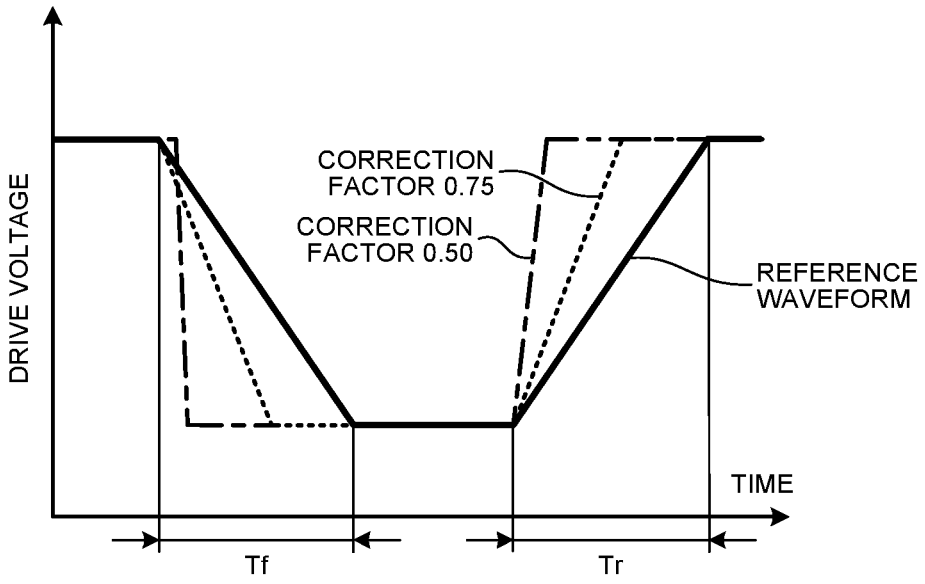
FIG. 16 is a table illustrating exemplary parameter sets applicable when a rise time and a fall time of the reference waveform data are subjected to correction.
FIG. 17 is a graph illustrating exemplary drive waveforms when the rise time and the fall time of the reference waveform data are corrected using the parameter sets illustrated in FIG. 16.

FIG. 16 is a table illustrating exemplary parameter sets applicable when the rise time and the fall time of the reference waveform data are subjected to correction. The parameter sets illustrated in FIG. 16 represent, as with the parameter sets exemplified in FIG. 14, sets of correction factors (correction parameters) established according to the simultaneously driven nozzle count X and the temperature T. It should, however, be noted that the parameter sets illustrated in FIG. 14 represent sets of correction factors with respect to the voltage value of the reference waveform data and the parameter sets illustrated in FIG. 16 represent sets of correction factors with respect to the rise time and the fall time of the reference waveform data.

FIG. 17 is a graph illustrating exemplary drive waveforms when the rise time and the fall time of the reference waveform data are corrected using the parameter sets illustrated in FIG. 16. In FIG. 17, the waveform indicated by the solid line represents a reference waveform corresponding to the reference waveform data before the correction (specifically, the correction factor of 1.0), the waveform indicated by the broken line represents a reference waveform corresponding to the reference waveform data having the rise time and the fall time corrected by a correction factor of 0.75, and the waveform indicated by the dash-single-dot line represents a reference waveform corresponding to the reference waveform data having the rise time and the fall time corrected by a correction factor of 0.50. The configuration of subjecting the rise time and the fall time of the reference waveform data to correction, as in the example of FIG. 17, allows variations in the ejection characteristics to be reduced without involving a voltage increase, so that an increase in power consumption can be reduced. Additionally, the drive waveform length can be reduced, which yields an advantage of capability of high frequency drive.

The data storage 100 stores the parameter set described above for each of the recording heads 15 of the image recording apparatus 1 in the first embodiment. The first embodiment exemplifies the correction parameters established according to the simultaneously driven nozzle count and the temperature as the parameter sets having discrete values as illustrated in FIGS. 14 and 16. This is, however, not the only possible configuration. Another configuration is possible in which the data storage 100 stores as the parameter sets, for example, functions of the simultaneously driven nozzle count and the temperature. An exemplary method for establishing the parameter set for each of the recording heads 15 will be described later.

The data storage 100 may be configured as a single non-volatile memory that retains all parameter sets associated with all recording heads 15 or as a plurality of non-volatile memories, each retaining each individual parameter set or a predetermined number of parameter sets.

When the data storage 100 is configured as a plurality of non-volatile memories, each retaining each individual parameter set, each of the non-volatile memories is assigned to each of the recording heads 15 and retains the parameter set associated with the specific recording head 15. When the specific recording head 15 is replaced with a new one, the foregoing configuration allows the parameter set associated with a new recording head 15 to be acquired.

When the data storage 100 is configured as a plurality of non-volatile memories, each retaining a predetermined number of parameter sets, each of the non-volatile memories is, for example, mounted on each of the drive control boards 14 and each of the non-volatile memories retains the parameter set associated with each of the recording heads 15 connected to the specific drive control board 14. This configuration allows the parameter set associated with each of the recording heads 15 of the image recording apparatus 1 to be controlled for each of the drive control boards 14 involved in driving the recording head 15.

When the data storage 100 is configured as a single non-volatile memory that retains all parameter sets associated with all recording heads 15, the non-volatile memory is required only to be disposed at any position in the apparatus main unit of the image recording apparatus 1. When the controller 60 is connected to the apparatus main unit, the non-volatile memory (the data storage 100) may be disposed at the controller 60.

Reference is made back to FIG. 13. The simultaneously driven nozzle count detector 101 detects the simultaneously driven nozzle count X for each of the recording heads 15 on the basis of the image data of the image to be recorded on the roll paper P. Specifically, whereas, in the comparative example, the total number of nozzles to be driven when an image for one line is recorded is detected as the simultaneously driven nozzle count, the number of nozzles to be driven when the image for one line is recorded is detected in the first embodiment as the simultaneously driven nozzle count X for each of the recording heads 15 included in the recording head array 18. The simultaneously driven nozzle count X for each of the recording heads 15 detected by the simultaneously driven nozzle count detector 101 is passed onto the correction parameter selector 103.

The temperature detector 102 detects the temperature T of the recording head 15 using, for example, a thermistor disposed inside the recording head 15. The temperature detector 102 may be configured so as to detect the temperature T of each of the recording heads 15. Alternatively, the temperature detector 102 may be configured so as to detect the temperatures T of some of the recording heads 15 to thereby let these temperatures T substitute the temperatures T of neighboring recording heads 15. The temperature T of the recording head 15 detected by the temperature detector 102 is passed onto the correction parameter selector 103.

The correction parameter selector 103 selects, for each of the recording heads 15 of the image recording apparatus 1, a correction parameter from among a plurality of correction parameters included in the parameter set associated with the specific recording head 15. The correction parameter thus selected varies depending on the simultaneously driven nozzle count X detected by the simultaneously driven nozzle count detector 101 and the temperature T detected by the temperature detector 102. For example, when the parameter set associated with a specific recording head 15 is the parameter set Y1 illustrated in FIG. 14, and when the simultaneously driven nozzle count X detected by the simultaneously driven nozzle count detector 101 falls in the range of $n1<X\leq n2$ and the temperature T detected by the temperature detector 102 is T2, then the correction parameter selector 103 selects 1.5 as the correction parameter (the correction factor with respect to the voltage of the reference waveform data in the example illustrated in FIG. 14) from among the correction parameters of the parameter set Y1. When, for example, the parameter set associated with a specific recording head 15 is the parameter set Y1 illustrated in FIG. 16, and when the simultaneously driven nozzle count X detected by the simultaneously driven nozzle count detector 101 falls in the range of $n1<X\leq n2$ and the temperature T detected by the temperature detector 102 is T2, then the correction parameter selector 103 selects 0.75 as the correction parameter (the correction factor with respect to the rise time and the fall time of the reference waveform data in the example illustrated in FIG. 16) from among the correction parameters of the parameter set Y1. The correction parameter selected for each of the recording heads 15 by the correction parameter selector 103 is passed onto the drive waveform data generator 104.

The drive waveform data generator 104 uses the correction parameter selected by the correction parameter selector 103 for each of the recording heads 15 to correct the reference waveform data, thereby generating the drive waveform data for each recording head 15. When, for example, the correction parameter selected by the correction parameter selector 103 for each recording head 15 is a correction factor with respect to the voltage of the reference waveform data, the drive waveform data generator 104 corrects the voltage of the reference waveform data using the correction factor selected for each recording head 15 to thereby generate the drive waveform data for each recording head 15. When, for example, the correction parameter selected by the correction parameter selector 103 for each recording head 15 is a correction factor with respect to the rise time and the fall time of the reference waveform data, the drive waveform data generator 104 corrects the rise time and the fall time of the reference waveform data using the correction factor selected for each recording head 15 to thereby generate the drive waveform data for each recording head 15. The drive waveform data generated by the drive waveform data generator 104 for each recording head 15 is transmitted from the controller 60 to the drive control board 14 to which the recording head 15 is connected. Thereafter, as in the comparative example, a drive waveform Vcom corresponding to the drive waveform data is supplied to the piezoelectric element 53 inside the recording head 15 and ejection of ink is performed.

Figure 18:
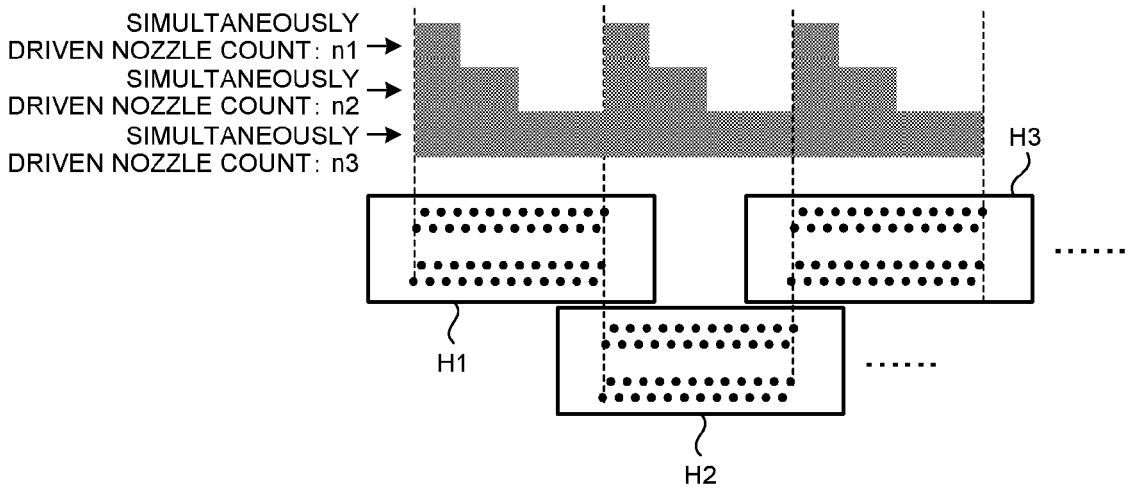
FIG. 18 is a diagram illustrating effects achieved by the present embodiment.

FIG. 18 is a diagram illustrating effects achieved by the present embodiment. FIG. 18 illustrates a configuration of, as in FIG. 12, the recording head array 18 that includes the three recording heads H1, H2, and H3 illustrated in FIGS. 11(*a*) and 11(*b*) arrayed in a zigzag pattern in a direction orthogonal to the conveyance direction of the roll paper P. In this configuration, FIG. 18 illustrates changes in the densities of images recorded when ink is ejected from each of the recording heads H1, H2, and H3 in a condition in which the drive waveform data is corrected using the correction parameter selected for each of the recording heads H1, H2, and H3 while the simultaneously driven nozzle count is varied in the order of n1, n2, n3.

In the first embodiment, the drive waveform data for driving each of the recording heads H1, H2, and H3 that constitute the recording head array 18 is corrected so as to absorb not only the variations in the ejection characteristics corresponding to the simultaneously driven nozzle count, but also differences in the ejection characteristics unique to each of the recording heads H1, H2, and H3. This approach allows uneven densities to be effectively prevented from occurring for each of the recording heads H1, H2, and H3 in the recorded images as illustrated in FIG. 18. High image quality can thus be achieved.

The following describes a specific example of a method for establishing the parameter set for each of the recording heads 15. The parameter set for each of the recording heads 15 included in the image recording apparatus 1 may, for example, be established before shipment of the image recording apparatus 1 and stored in the data storage 100. The following describes, as the exemplary method for establishing the parameter set for each recording head 15, a method that selects an optimum parameter set for each recording head 15 from among predetermined parameter sets. The example to be described hereunder selects an optimum parameter set for each recording head 15 from among the parameter sets Y1, Y2, Y3, Y4, Y5, . . . illustrated in FIG. 14 or 16.

In this example, a test chart is recorded on the roll paper P using the recording heads 15. The test chart is then used to establish the parameter set for each recording head 15 from among the parameter sets Y1, Y2, Y3, Y4, Y5, . . . illustrated in FIG. 14 or 16.

Figure 19:
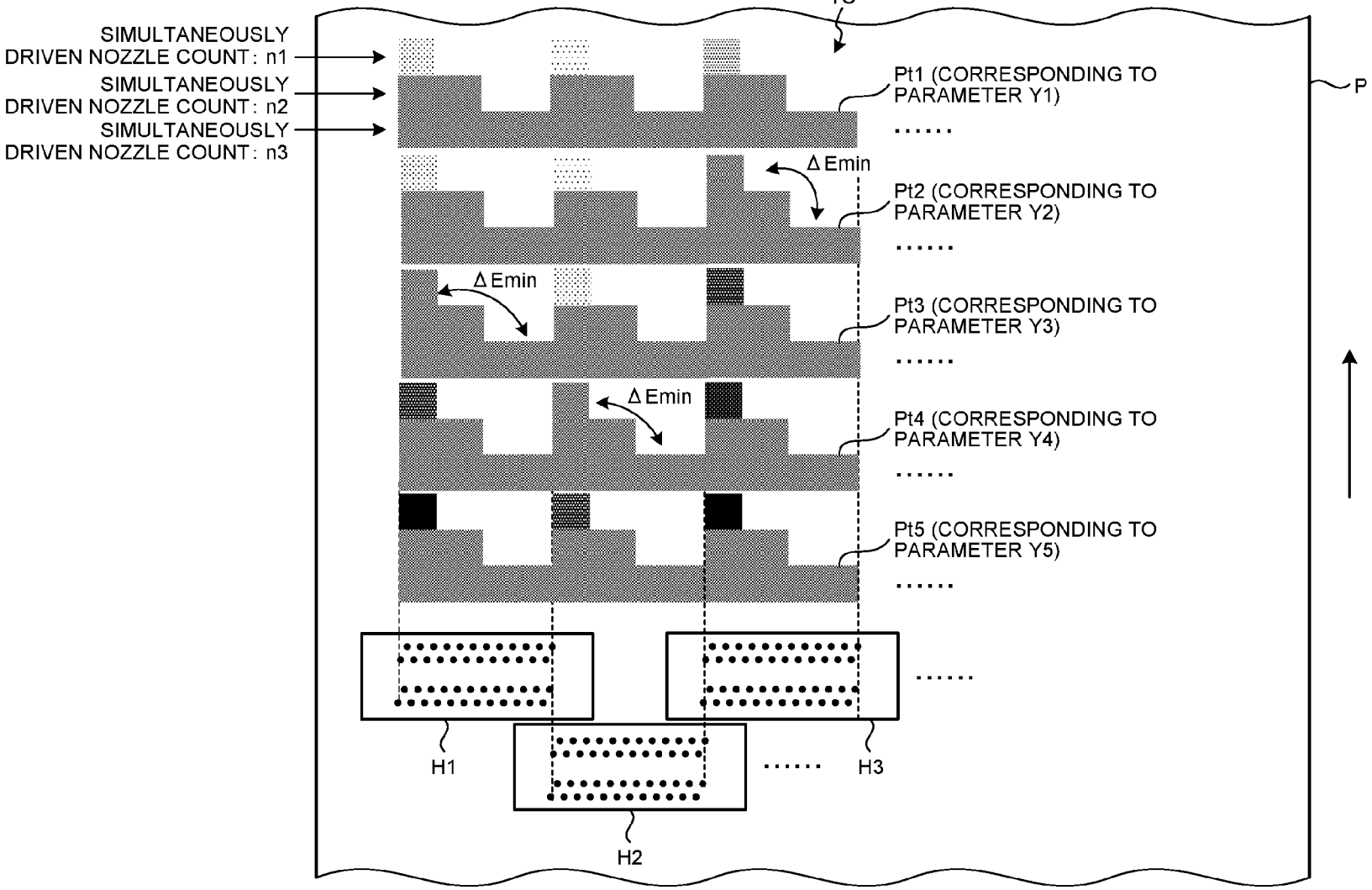
FIG. 19 is a schematic diagram illustrating how a test chart is recorded on roll paper.

FIG. 19 is a schematic diagram illustrating how a test chart TC is recorded on the roll paper P. The test chart TC includes a plurality of patterns Pt1, Pt2, Pt3, Pt4, Pt5, . . . corresponding to the respective parameter sets Y1, Y2, Y3, Y4, Y5, . . . . Each pattern is recorded on the roll paper P through an operation of ejecting ink from the recording heads H1, H2, and H3 and using the corresponding parameter set, while varying the simultaneously driven nozzle count in the order of n1, n2, n3. These patterns are recorded in sequence on the roll paper P that is conveyed in the direction indicated by the arrow in FIG. 19, while the parameter set to be used is changed in sequence. The test chart TC illustrated in FIG. 19 is thus obtained.

The pattern recorded using the parameter set optimum for a specific recording head 15 exhibits a small density difference ΔE corresponding to the change in the simultaneously driven nozzle count in a portion recorded by the specific recording head 15. The parameter set corresponding to the specific recording head 15 may therefore be determined by the following procedure. Specifically, with respect to each of the patterns Pt1, Pt2, Pt3, Pt4, Pt5, . . . included in the test chart C, the density difference ΔE corresponding to the change in the simultaneously driven nozzle count in the portion recorded by the specific recording head 15 is checked and the parameter set corresponding to the pattern that exhibits the smallest density difference ΔE is determined as the parameter set corresponding to the specific recording head 15.

In the example of FIG. 19, the pattern Pt3 exhibits the smallest density difference ΔE (ΔEmin) in the portion recorded by the recording head H1. The parameter set Y3 corresponding to the pattern Pt3 is thus determined as the parameter set corresponding to the recording head H1. Similarly, the pattern Pt4 exhibits the smallest density difference ΔE (ΔEmin) in the portion recorded by the recording head H2. The parameter set Y4 corresponding to the pattern Pt4 is thus determined as the parameter set corresponding to the recording head H2. Similarly, the pattern Pt2 exhibits the smallest density difference ΔE (ΔEmin) in the portion recorded by the recording head H3. The parameter set Y2 corresponding to the pattern Pt2 is thus determined as the parameter set corresponding to the recording head H3. The parameter set for each recording head 15 determined in the foregoing manner is stored in the data storage 100 by having the parameter set associated with, for example, the identification information of the recording head 15.

As described above with reference to specific examples, the image recording apparatus 1 in the first embodiment retains a parameter set for each of the recording heads 15 and selects, from among the correction parameters included in the parameter set, a correction parameter corresponding to the simultaneously driven nozzle count detected for each of the recording heads 15. The image recording apparatus 1 then corrects the reference waveform data using the correction parameter selected for each of the recording heads 15 and generates the drive waveform data for each of the recording heads 15 to drive the recording head 15. The image recording apparatus 1 in the first embodiment thus absorbs not only variations in the ejection characteristics corresponding to the simultaneously driven nozzle count, but also differences in the ejection characteristics unique to each of the recording heads 15 that constitute the recording head array 18, so that degradation of image quality can be effectively prevented.

The image recording apparatus 1 in the first embodiment detects, in addition to the simultaneously driven nozzle count, the temperature of the recording head 15 and, on the basis of the detected simultaneously driven nozzle count and temperature, selects the correction parameter from the parameter set. The image recording apparatus 1 can thus absorb variations in the ejection characteristics arising from changes in the temperature to thereby be able to achieve high image quality.

Second Embodiment

The following describes an image recording apparatus 1 according to a second embodiment that has a function of selecting a parameter set for each of the recording heads 15 and storing the parameter set in the data storage 100. Specifically, the image recording apparatus 1 in the second embodiment is capable of updating the parameter set for each of the recording heads 15 retained by the data storage 100 through calibration performed as appropriate after the image recording apparatus 1 has been subjected to a use environment of the user following shipment from a factory. This capability allows the parameter set for each of the recording heads 15 to be maintained in an optimum condition even with a change in the recording heads 15 over time, for example, a change in the ejection characteristics due to, for example, a change in capacitance of a piezoelectric element 53 over time, thereby effectively preventing image quality from being degraded.

Figure 20:
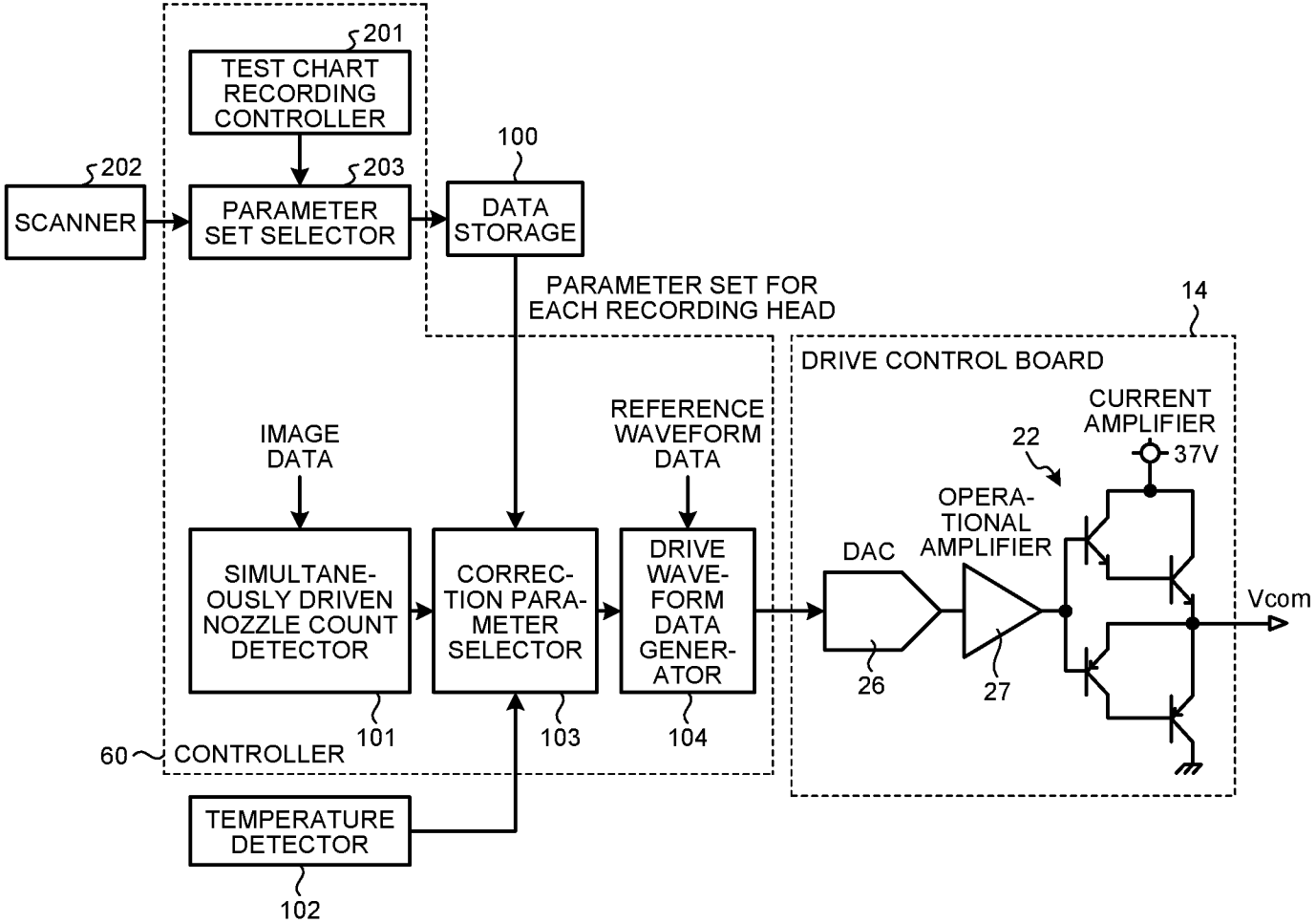
FIG. 20 is a block diagram illustrating a circuit configuration in a second embodiment of the present invention.

FIG. 20 is a block diagram illustrating a circuit configuration in the second embodiment. The circuit configuration in the second embodiment includes a test chart recording controller 201, a scanner 202, and a parameter set selector 203, in addition to the elements of the circuit configuration in the first embodiment illustrated in FIG. 13. The scanner 202 is connected to the apparatus main unit of the image recording apparatus 1. The test chart recording controller 201 and the parameter set selector 203 are disposed, for example, in a controller 60 disposed in or connected to the apparatus main unit of the image recording apparatus 1. The circuit configuration in the second embodiment has the same circuit configuration in the first embodiment in other respects. The following focuses on only differences from the first embodiment.

The test chart recording controller 201, upon receipt of an instruction to start the calibration by an operator, for example, controls to record the test chart TC as illustrated in FIG. 19 on the roll paper P. Specifically, the test chart recording controller 201 causes the recording heads 15 to eject ink onto the roll paper P being conveyed using a predetermined plurality of parameter sets Y1, Y2, Y3, Y4, Y5, . . . in sequence, while varying the simultaneously driven nozzle count, to thereby record the test chart TC that includes a plurality of patterns Pt1, Pt2, Pt3, Pt4, Pt5, . . . corresponding to the parameter sets Y1, Y2, Y3, Y4, Y5, . . . .

The scanner 202 optically reads the test chart TC recorded on the roll paper P and generates image data that represents densities of the patterns Pt1, Pt2, Pt3, Pt4, Pt5, . . . included in the test chart TC. The image data generated by the scanner 202 is transmitted to the controller 60 and is input to the parameter set selector 203. It is noted that the second embodiment causes the scanner 202 to detect the densities of the patterns Pt1, Pt2, Pt3, Pt4, Pt5, . . . included in the test chart TC; nonetheless, instead of the scanner 202, another density sensor that can detect densities of images may be connected to the apparatus main unit of the image recording apparatus 1.

The parameter set selector 203 calculates the above-described density difference ΔE for each portion recorded by each of the recording heads 15 with respect to each of the patterns Pt1, Pt2, Pt3, Pt4, Pt5, . . . on the basis of the image data generated by the scanner 202. The parameter set selector 203 then selects the parameter set corresponding to the pattern that exhibits the smallest density difference ΔE of the portion recorded by a specific recording head 15 as the parameter set corresponding to the recording head 15. The parameter set selector 203 stores the selected parameter set in the data storage 100 by having the selected parameter set associated with, for example, the identification information of the recording head 15.

As described above, the image recording apparatus 1 in the second embodiment can automatically select the parameter set optimum for each of the recording heads 15 and store the selected parameter set in the data storage 100 by performing calibration as appropriate. The image recording apparatus 1 in the second embodiment thus can maintain the parameter set for each of the recording heads 15 in an optimum condition even with a change in the ejection characteristics due to, for example, a change in the recording head 15 over time, to thereby effectively prevent image quality from being degraded.

Third Embodiment

The following describes a third embodiment in which the operator can specify a parameter set for each of the recording heads 15 to be stored in the data storage 100. The image recording apparatus 1 according to the third embodiment can update the parameter set for each of the recording heads 15 to be stored in the data storage 100 through calibration performed as appropriate, as in the image recording apparatus 1 in the second embodiment. It is noted that the image recording apparatus 1 in the second embodiment causes the scanner 202 to read the test chart TC recorded on the roll paper P and automatically selects a parameter set optimum for each of the recording heads 15 to store the parameter set in the data storage 100. In contrast, in the third embodiment, the operator who has checked the test chart TC performs an operating input to specify the parameter set for each of the recording heads 15. The image recording apparatus 1 in the third embodiment then receives the operating input performed by the operator, selects the parameter set as the parameter set corresponding to the corresponding recording head 15, and stores the parameter set in the data storage 100.

Figure 21:
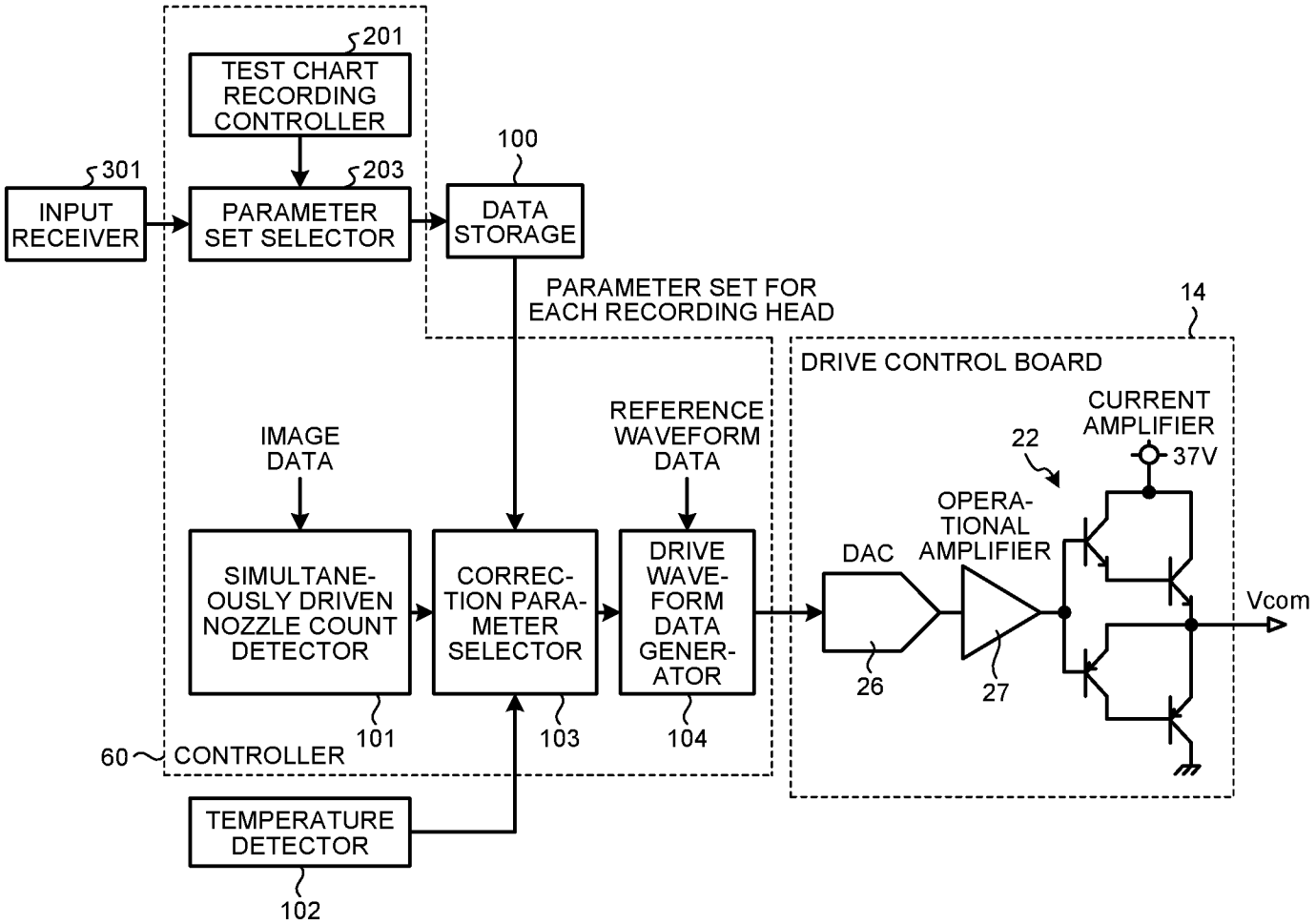
FIG. 21 is a block diagram illustrating a circuit configuration in a third embodiment of the present invention.

FIG. 21 is a block diagram illustrating a circuit configuration of the third embodiment. The circuit configuration in the third embodiment includes an input receiver 301 in place of the scanner 202 in the circuit configuration of the second embodiment illustrated in FIG. 20. The circuit configuration in the third embodiment has the same circuit configuration in the second embodiment in other respects. The following focuses on only differences from the second embodiment.

The input receiver 301 receives an operating input performed by the operator to specify the parameter set for each of the recording heads 15. An example of the input receiver 301 includes an operator panel connected to the apparatus main unit of the image recording apparatus 1. When a computer apparatus including a touch panel display and various types of input devices such as a keyboard, a mouse, and a microphone is used as the controller 60 connected to the apparatus main unit of the image recording apparatus 1, the input device of the controller 60 may be used as the input receiver 301.

In the third embodiment, when the calibration is started, a test chart recording controller 201 controls so as to record the test chart TC on the roll paper P as in the second embodiment. However, the operator checks the densities of the patterns Pt1, Pt2, Pt3, Pt4, Pt5, . . . included in the test chart TC either visually or using a separately provided densitometer. On the basis of the densities of the patterns Pt1, Pt2, Pt3, Pt4, Pt5, . . . included in the test chart TC, the operator identifies a specific parameter set optimum for each of the recording heads 15 from among the parameter sets Y1, Y2, Y3, Y4, Y5, . . . used for recording the test chart TC and performs an operating input to specify the parameter set for each of the recording heads 15. This operating input performed by the operator is received by the input receiver 301. Information of the operating input performed by the operator and received by the input receiver 301 is input to a parameter set selector 203.

The parameter set selector 203 in the third embodiment selects, from among the parameter sets Y1, Y2, Y3, Y4, Y5, . . . used for recording the test chart TC, the parameter set corresponding to each of the recording heads 15 on the basis of the operating input of the operator received by the input receiver 301. The parameter set selector 203 stores the parameter set selected for each of the recording heads 15 in the data storage 100 by having the parameter set associated, for example, with the identification information of the recording head 15.

As described above, when the operator specifies the parameter set optimum for each of the recording heads 15 after the calibration performed as appropriate, the image recording apparatus 1 in the third embodiment can store the parameter set specified by the operator in the data storage 100. As in the second embodiment, the image recording apparatus 1 in the third embodiment thus can maintain the parameter set for each of the recording heads 15 in an optimum condition even with a change in the ejection characteristics due to, for example, a change in the recording head 15 over time, to thereby effectively prevent image quality from being degraded.

Fourth Embodiment

The following describes a fourth embodiment in which the parameter set for each of the recording heads 15 to be stored in the data storage 100 is selected by a method different from the methods in the second and third embodiments. The fourth embodiment uses a residual vibration detection technique to select the parameter set for each of the recording heads 15 to be stored in the data storage 100, thereby reducing variations in the ejection characteristics arising from variations in the capacitance of the piezoelectric elements 53 in the recording head 15.

Figure 22:
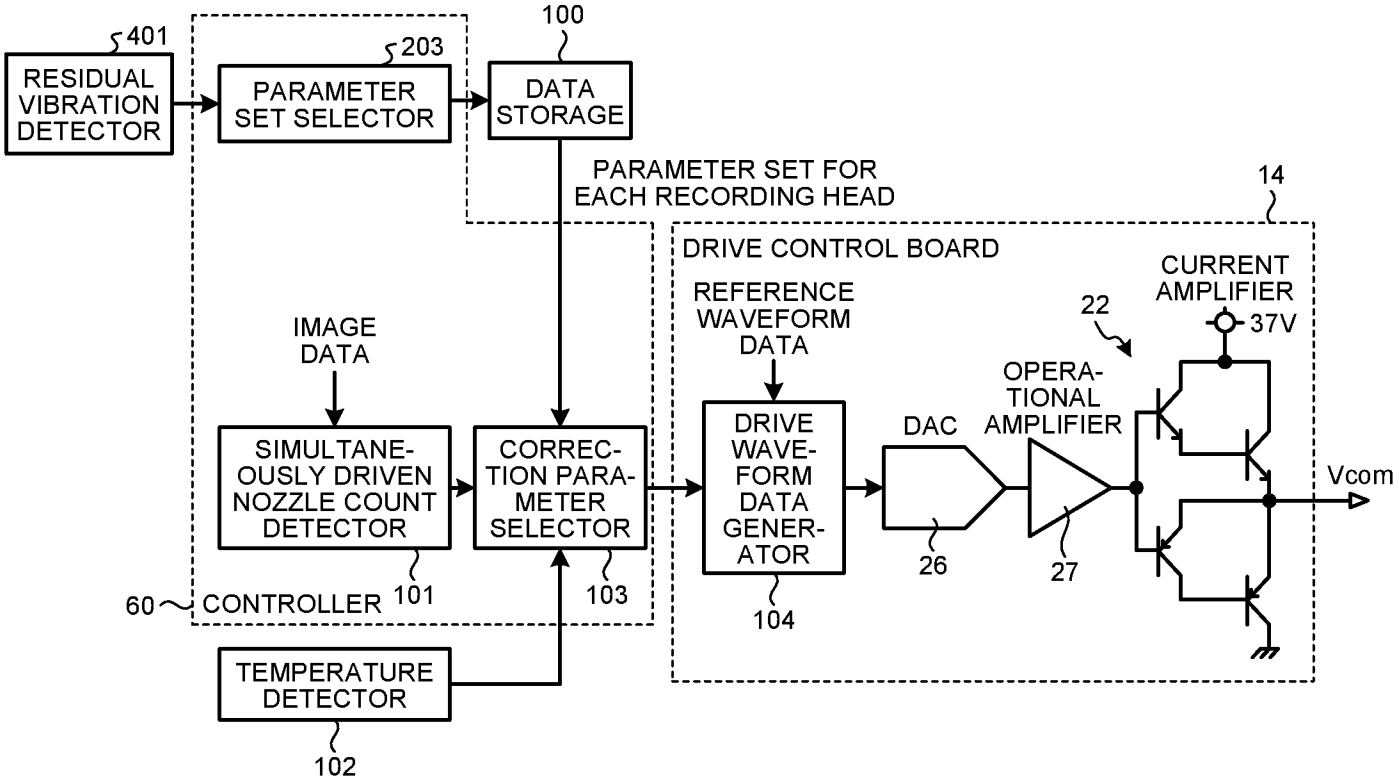
FIG. 22 is a block diagram illustrating a circuit configuration in a fourth embodiment of the present invention.

FIG. 22 is a block diagram illustrating a circuit configuration of the fourth embodiment. The circuit configuration in the fourth embodiment includes a residual vibration detector 401 in place of the scanner 202 in the circuit configuration of the second embodiment illustrated in FIG. 20 and the input receiver 301 in the circuit configuration of the third embodiment illustrated in FIG. 21. Additionally, the circuit configuration in the fourth embodiment does not include the test chart recording controller 201. The drive waveform data generator 104 is disposed on the drive control board 14 instead of the controller 60 in the circuit configuration in the fourth embodiment. The circuit configuration in the fourth embodiment has the same circuit configurations in the second and third embodiments in other respects. The following focuses on only differences from the second and third embodiments.

The residual vibration detector 401 detects a residual vibration waveform of each of the recording heads 15 driven on the basis of the drive waveform data generated using a predetermined plurality of parameter sets Y1, Y2, Y3, Y4, Y5, . . . . The residual vibration detector 401 then calculates an amplitude value $V_{Hx}$ of the residual vibration waveform for each combination of a parameter set and a recording head 15. The residual vibration detection technique will be described in detail later.

On the basis of the amplitude value $V_{Hx}$ of the residual vibration waveform calculated by the residual vibration detector 401, a parameter set selector 203 in the fourth embodiment selects, for each recording head 15, a parameter set that results in the smallest difference in the amplitude value $V_{Hx}$ of the residual vibration waveform between of the recording heads 15, from among the parameter sets Y1, Y2, Y3, Y4, Y5, . . . . The parameter set selector 203 then stores the selected parameter set for each of the recording heads 15 in the data storage 100 by having the selected parameter set associated with, for example, the identification information of the recording head 15.

The fourth embodiment is configured such that, as described above, the residual vibration detection technique is employed to select the parameter set for each of the recording heads 15. Thus, unlike the second and third embodiments, the fourth embodiment does not require that the test chart TC be recorded on the roll paper P. As a result, occurrence of downtime of the image recording apparatus 1 and an increase in ink consumption involved in the recording of the test chart TC can be reduced.

Figure 23A:
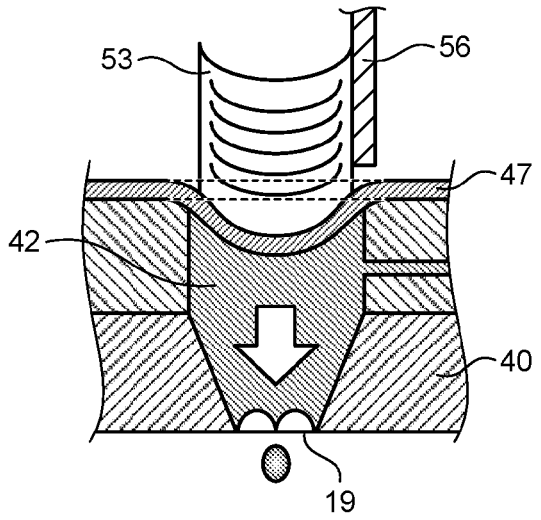
FIGS. 23A and 23B are diagrams illustrating theory by which a residual vibration occurs.
Figure 23B:
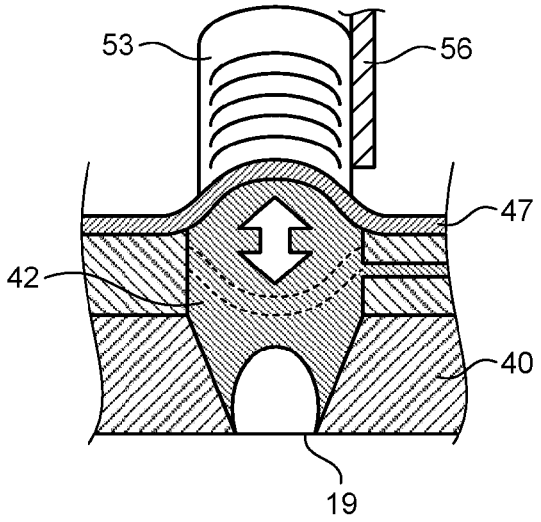

The following describes in detail the residual vibration detection technique using the residual vibration detector 401. A residual vibration occurring in the recording head 15 will first be described with reference to FIGS. 23A and 23B. FIGS. 23A and 23B are diagrams illustrating theory by which the residual vibration occurs. FIG. 23A schematically illustrates a change in pressure occurring inside the pressure chamber 42 during ejection of ink and FIG. 23B schematically illustrates a change in pressure occurring inside the pressure chamber 42 after the ejection of ink.

During the ejection of ink illustrated in FIG. 23A, the piezoelectric element drive IC 55 is turned ON or OFF according to the image data transmitted from the drive control board 14 and the drive waveform is applied to the electrode pad 56. An expansion and contraction force of the piezoelectric element 53 based on the drive waveform propagates to the pressure chamber 42 via the vibration plate 47 to thereby generate pressure acting toward the nozzle 19 inside the pressure chamber 42. The ink is thereby ejected from the nozzle 19. After the ejection of ink illustrated in FIG. 23B, a residual pressure wave generated in the pressure chamber 42 after the ejection of ink propagates to the piezoelectric element 53 via the vibration plate 47, so that a residual vibration voltage is induced in the electrode pad 56. By detecting a change in the induced residual vibration voltage, a change in the ink ejection velocity and ejection amount as a result of a change in the ejection characteristics of the recording head 15, specifically, a change in ink viscosity, and the condition of the nozzle 19 can be determined.

Figure 24:
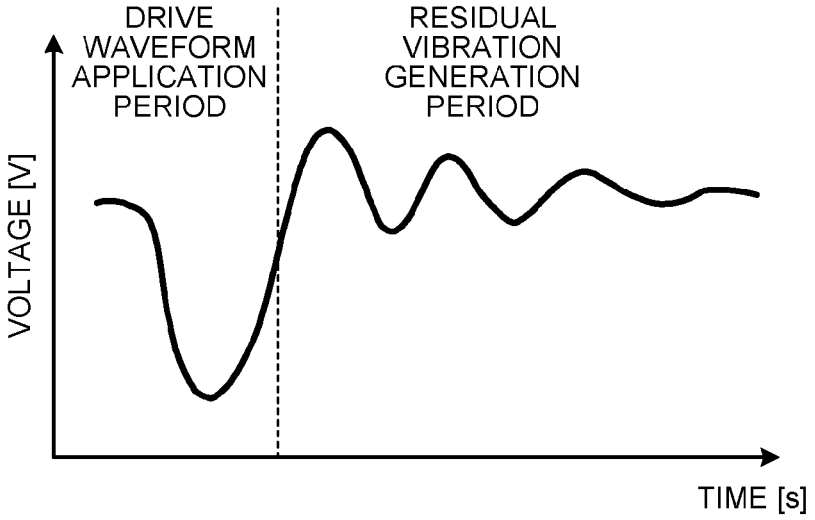
FIG. 24 is a graph illustrating exemplary drive waveform and residual vibration waveform.

FIG. 24 is a graph illustrating exemplary drive waveform and residual vibration waveform. The drive waveform application period in FIG. 24 corresponds to the operation illustrated in FIG. 23A. When the piezoelectric element 53 is compressed by a falling operation of the drive waveform and is then expanded by a rising operation of the drive waveform, the residual vibration occurs following the application of the drive waveform. The residual vibration generation period in FIG. 24 corresponds to the operation illustrated in FIG. 23B. The propagation of the residual pressure wave to the piezoelectric element 53 via the vibration plate 47 results in a damping vibration waveform as illustrated in FIG. 24. The residual vibration detection technique determines a change in the ejection characteristics of the recording head 15 using the vibration waveform described above, specifically, a change in the residual vibration voltage. In the following, a series of operations from the application of the drive waveform described above to the detection of a change in the residual vibration voltage caused by variations in pressure occurring inside the pressure chamber 42 will be referred to as a residual vibration detection operation.

While the residual vibration detection technique has been described for a case in which ink is ejected, the residual vibration detection technique is required only to be capable of detecting a change in the residual vibration voltage caused by the residual pressure wave occurring in the pressure chamber 42 and does not necessarily have to involve the ejection of ink. Use of the residual vibration detection technique not involving the ejection of ink enables detection of variations in the ejection characteristics for each of the recording heads 15, so that reduction can be achieved in the amount of ink and recording medium including the roll paper P.

Figure 25:
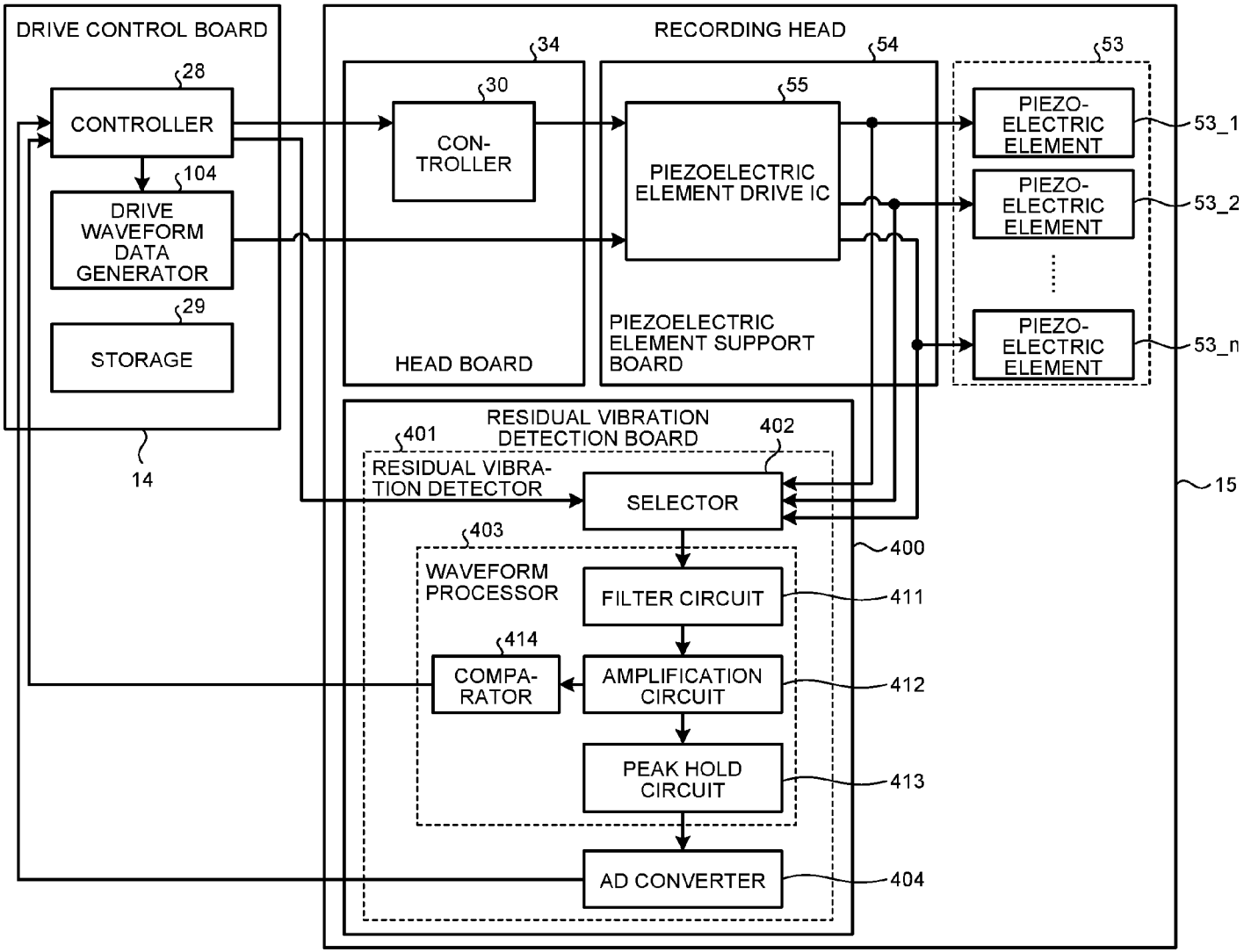
FIG. 25 is a block diagram illustrating an exemplary configuration of a residual vibration detector.

FIG. 25 is a block diagram illustrating an exemplary configuration of the residual vibration detector 401. In the example illustrated in FIG. 25, the residual vibration detector 401 is achieved on a residual vibration detection board 400 mounted on the recording head 15. The residual vibration detection board 400 is connected to the drive control board 14 and a piezoelectric element support board 54 of the recording head 15.

The drive control board 14 includes a controller 28, the drive waveform data generator 104, and a storage 29. Specifically, the controller 28 generates a timing control signal and drive waveform data on the basis of the image data. The drive waveform data generator 104 subjects the generated drive waveform data to DA conversion and amplifies voltage and current. The storage 29 stores in advance damping ratio data that serves as a reference and variations for each nozzle 19 of the recording head 15.

A digital signal including the timing control signal generated by the controller 28 of the drive control board 14 is transmitted to the recording head 15 by serial communication. A controller 30 on the head board 34 deserializes the digital signal and inputs the resultant signal to the piezoelectric element drive IC 55. The drive waveform data generator 104 generates a residual vibration detection waveform using a signal from the controller 28. The residual vibration detection waveform is input to the piezoelectric element 53 according as the piezoelectric element drive IC 55 is turned ON or OFF by the timing control signal. It is noted that, in FIG. 25, n piezoelectric elements 53 are denoted as 53_1, 53_2, . . . , and **53_*n*. Additionally, the controller 30 transmits to the residual vibration detection board 400 a selector signal that is synchronized with the timing control signal transmitted to the piezoelectric element drive IC 55, to thereby control a timing at which the residual vibration detector 401 reads the residual vibration voltage to be generated in the piezoelectric element 53** after the ejection of ink.

The residual vibration detector 401 includes a selector 402, a waveform processor 403, and an AD converter 404. The waveform processor 403 includes a filter circuit 411, an amplification circuit 412, a peak hold circuit 413, and a comparator 414. The amplitude value held by the peak hold circuit 413 is converted into a corresponding digital value by the AD converter 404 and the resultant digital value is fed back to the controller 28 of the drive control board 14. An output from the amplification circuit 412 is input also to the comparator 414 and a waveform output from the comparator 414 is fed back to the controller 28 of the drive control board 14. The controller 28 finds the amplitude value of the residual vibration waveform and performs an arithmetic operation of calculating a damping ratio. The controller 28 then compares the damping ratio with damping ratio data stored in the storage 29, thereby detecting the condition of the nozzle 19 in each recording head 15.

In the example illustrated in FIG. 25, the controller 28 that has the function of calculating the damping ratio and frequency is disposed on the drive control board 14. This is, however, not the only possible configuration. Another configuration may be possible in which the controller 28 is mounted, for example, on the recording head 15, and not on the drive control board 14. In addition, in the example illustrated in FIG. 25, the residual vibration detector 401 is achieved on the residual vibration detection board 400. Nonetheless, part or all of the functions of the residual vibration detector 401 may be achieved on the drive control board 14 or on the head board 34.

Additionally, in the example illustrated in FIG. 25, the residual vibration voltage of each of the n piezoelectric elements 53 of 53_1, 53_2, . . . , and **53_*n*, as selected in sequence, is detected by one set of the selector 402, the waveform processor 403, and the AD converter 404. A configuration may nonetheless be possible in which the selector 402, the waveform processor 403, and the AD converter 404 that correspond in number to the piezoelectric elements 53 are incorporated so that ink viscosity conditions of all nozzles 19 are simultaneously detected. Alternatively, all piezoelectric elements 53 may be divided into groups and the selector 402, the waveform processor 403, and the AD converter 404 may be applied to each of these groups, so that a specific piezoelectric element 53** may be selected in sequence within the specific group. This approach has an advantage of an increased number of nozzles for which the residual vibration waveform can be simultaneously detected and a reduced number of circuits required.

Figure 26:
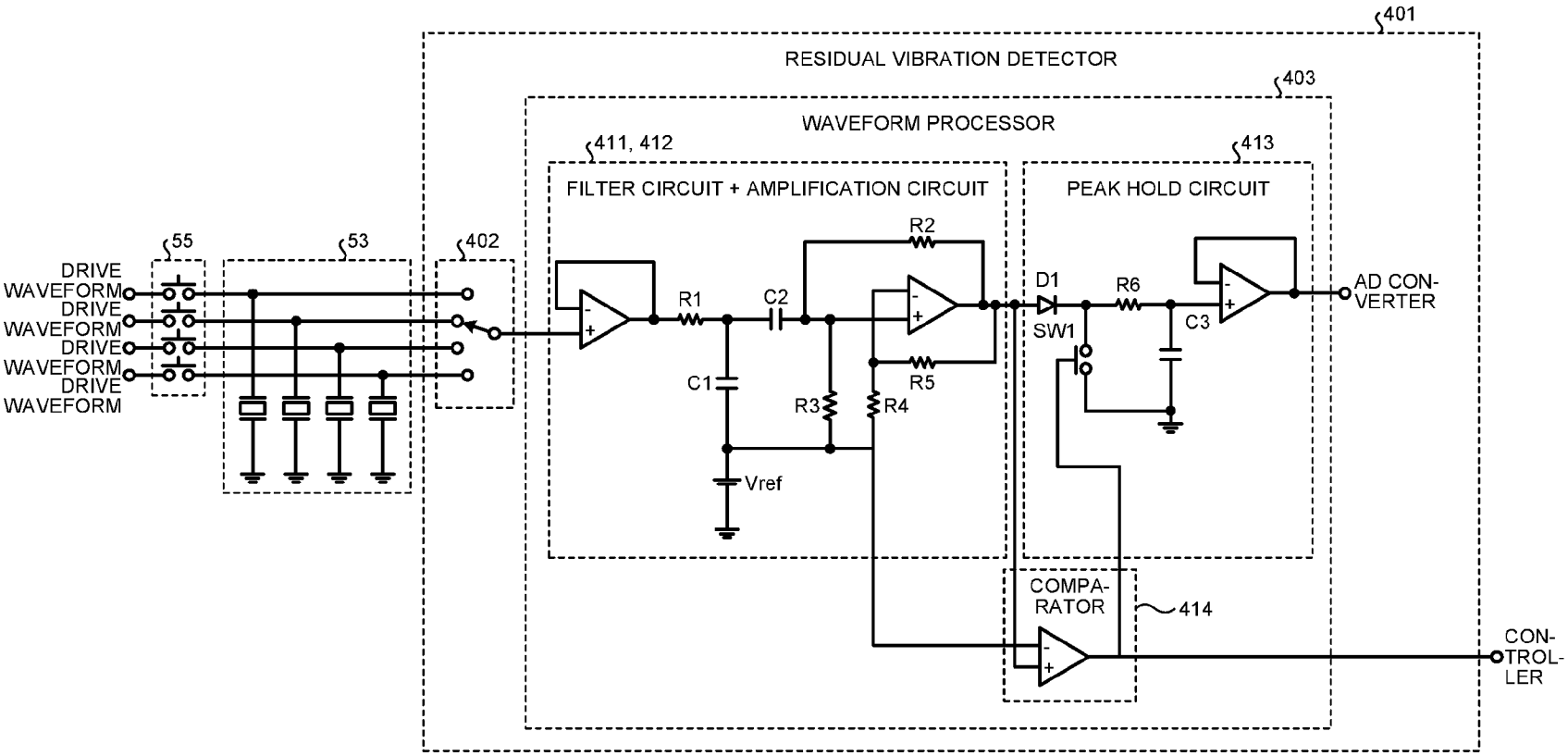
FIG. 26 is an exemplary circuit diagram illustrating a residual vibration detector.

FIG. 26 is an exemplary circuit diagram illustrating the residual vibration detector 401. In FIG. 26, turning ON each of the piezoelectric element drive ICs 55 enables control of the timing at which the drive waveform is applied to each of the piezoelectric elements 53, so that ink can be ejected. At a timing at which the piezoelectric element drive IC 55 is turned OFF following the ejection of ink, the piezoelectric element 53 for which the residual vibration waveform is to be detected is connected to the waveform processor 403 through the operation of the selector 402 according to the selector signal. This operation allows the amplitude value of the residual vibration waveform to be recognized. The waveform processor 403 includes a high impedance buffer to receive a micro residual vibration waveform, thereby minimizing effects thereof on the residual vibration waveform. The filter circuit 411 and the amplification circuit 412 are formed of a bandpass filter amplification type, what is generally called a Sallen-Key type. Characteristically, the filter circuit 411 has a predetermined passband width with a meniscus natural vibration frequency determined by the characteristic of the recording head 15 as a central frequency. Additionally, high frequency and low frequency noise can be efficiently removed by, for example, setting a bandwidth of −3 dB from either end of the passband width about three times that of the passband width. The amplification circuit 412 is set to have such an amplification factor that the waveform is amplified to fall within an input range of the AD converter 404.

A resistor R6 and a capacitor C3 of the peak hold circuit 413 have a discharge time determined to ½ or less of a residual vibration cycle. The comparator 414 produces a high output when the damping vibration waveform input thereto is equal to or higher than a reference voltage Vref. The output from the comparator 414 is input to the controller 28 of the drive control board 14 and the controller 28 detects the frequency from a rise cycle or a fall cycle. When the damping vibration waveform is equal to or lower than the reference voltage Vref, a switch SW1 turns ON and the peak hold circuit 413 is reset. This is, however, not the only possible arrangement and the reset timing is required only to allow the amplitude value of the damping vibration waveform to be recognized. The configuration of the peak hold circuit 413 is not limited to the circuit configuration illustrated in FIG. 26 either, and is required only to have a function of recognizing the amplitude value. It is noted that the filter circuit 411 and the amplification circuit 412 are not limited to the Sallen-Key type. The filter circuit 411 and the amplification circuit 412 are required only to be configured as a filter having high-pass and low-pass characteristics and as a non-inverting or inverting amplifier, respectively.

Figure 27:
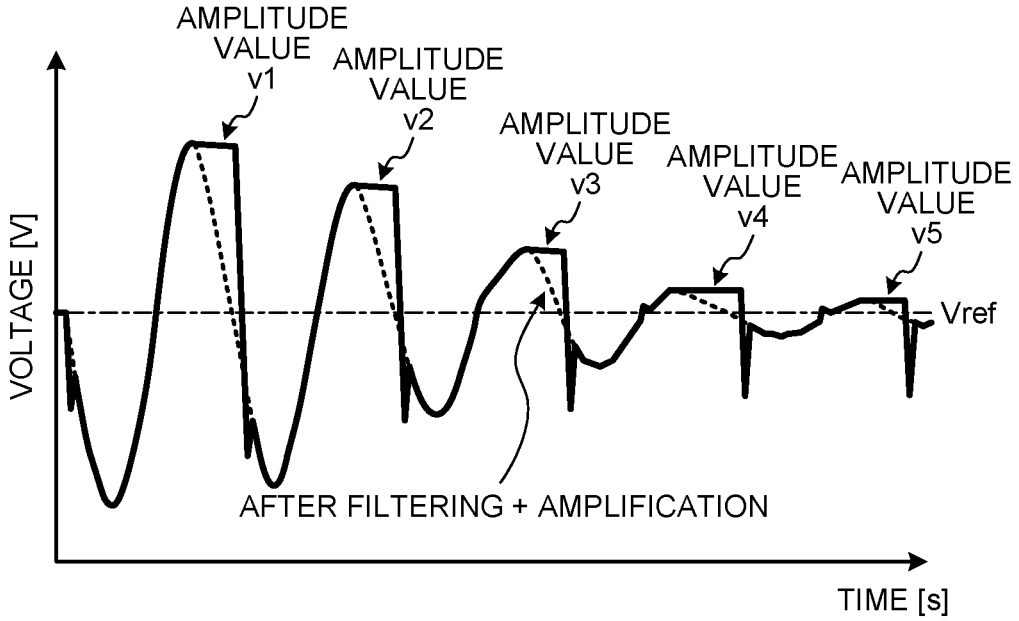
FIG. 27 is an exemplary residual vibration waveform detected by the residual vibration detector illustrated in FIG. 26.

FIG. 27 is an exemplary residual vibration waveform detected by the residual vibration detector 401 illustrated in FIG. 26. In FIG. 27, the waveform indicated by the broken line represents an experimental waveform of the residual vibration after filtering and amplification by the filter circuit 411 and the amplification circuit 412, and the waveform indicated by the solid line represents an experimental waveform of the amplitude value of each half wave held by the peak hold circuit 413. In the example of FIG. 27, for example, the controller 28 of the drive control board 14 can calculate a voltage amplitude value that averages amplitude damping factors for four cycles. The configuration may nonetheless detect only the amplitude value v1, in which case, the amplitude value can be calculated within a short period of time. Another approach is to calculate the voltage amplitude value that averages the amplitude damping factors for cycles excluding half waves that are heavily affected by disturbances and that have large noise. Note steep waveforms that can be observed below the reference voltage Vref. These steep waveforms represent undershoot occurring as a result of an instantaneous discharge of the capacitor C3 of the peak hold circuit 413. Additionally, the amplitude values, although being detected from the plus side of the voltage in FIG. 27, may even be detected from the minus side of the voltage.

Figure 28:
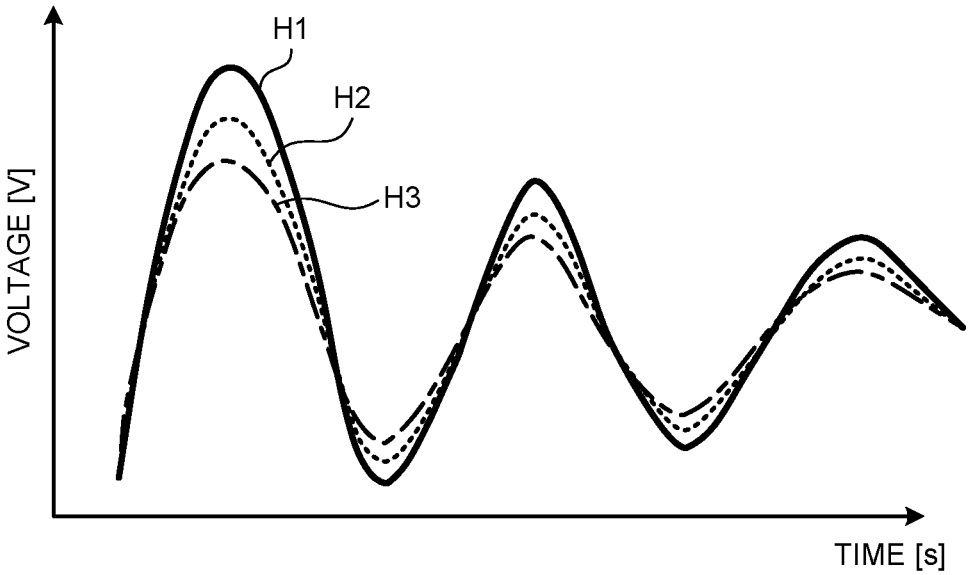
FIG. 28 is a graph illustrating an exemplary residual vibration waveform output from each of the recording heads that constitute the recording head array.

FIG. 28 is a graph illustrating an exemplary residual vibration waveform output from each of the recording heads 15 that constitute the recording head array 18. FIG. 28 illustrates the residual vibration waveforms output from the three recording heads 15 (the recording heads H1, H2, and H3). The waveform indicated by the solid line represents the residual vibration waveform output from the recording head H1, the waveform indicated by the dotted line represents the residual vibration waveform output from the recording head H2, and the waveform indicated by the dash-single-dot line represents the residual vibration waveform output from the recording head H3.

Assume that the piezoelectric elements 53 of the recording heads 15 that constitute the recording head array 18 have varying values of capacitance and capacitance $C_{H1}$ of the piezoelectric elements 53 of the recording head H1, capacitance $C_{H2}$ of the piezoelectric elements 53 of the recording head H2, and capacitance $C_{H3}$ of the piezoelectric elements 53 of the recording head H3 have the following relation, specifically, $C_{H1}>C_{H2}>C_{H3}$. In this condition, amplitude values $V_{H1}$, $V_{H2}$, and $V_{H3}$ of the residual vibration waveforms output from the respective recording heads 15 have the following relation, specifically, $V_{H1}>V_{H2}>V_{H3}$. Thus, selecting the parameter set for each of the recording heads 15 so that a difference is small in the amplitude value $V_{Hx}$ between the residual vibration waveforms output from the recording heads 15 that constitute the recording head array 18 absorbs variations in the capacitance of the piezoelectric elements 53 for each recording head 15, thereby enabling reduction in variations in the ejection characteristics in each recording head 15.

Figures 29A, 29B:
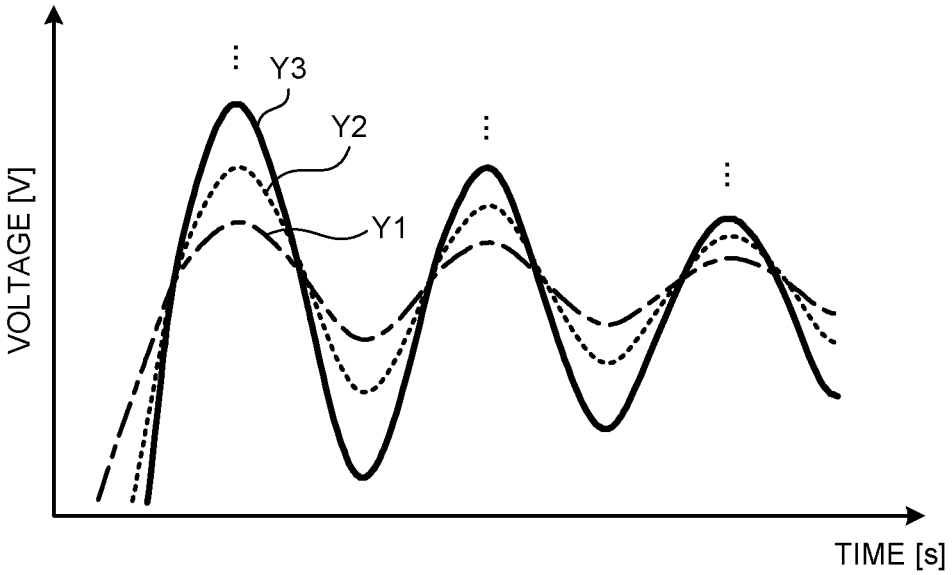
FIGS. 29A and 29B are diagrams illustrating a method for selecting the parameter set by a parameter set selector 203 illustrated in FIG. 22.

FIGS. 29A and 29B are diagrams illustrating a method for selecting the parameter set by the parameter set selector 203 illustrated in FIG. 22. FIG. 29A illustrates exemplary residual vibration waveforms when the drive voltage waveforms generated using the parameter sets described previously are applied. FIG. 29B illustrates specific examples of the amplitude values $V_{Hx}$ of the residual vibration waveforms calculated for different combinations of the parameter set and the recording head 15.

When the parameter set for each of the recording heads 15 is to be selected in the image recording apparatus 1 according to the fourth embodiment, the residual vibration detection operation described previously is performed for each of the recording heads 15 using the parameter sets Y1, Y2, Y3, Y4, Y5, . . . predetermined for each recording head 15. Then, the residual vibration detector 401 calculates the amplitude values $V_{H1}$, $V_{H2}$, and $V_{H3}$ of the residual vibration waveforms output from the respective recording heads 15. The parameter set selector 203 compares one amplitude value $V_{Hx}$ of the residual vibration waveform calculated for each of the recording heads 15 with another and selects, for each of the recording heads 15, a parameter set that results in the smallest difference in the amplitude value $V_{Hx}$ of the residual vibration waveform between of the recording heads 15. Assume, for example, that the amplitude value $V_{H1}$ of the residual vibration waveform output from the recording head H1, the amplitude value $V_{H2}$ of the residual vibration waveform output from the recording head H2, and the amplitude value $V_{H3}$ of the residual vibration waveform output from the recording head H3 are as illustrated in FIG. 29B. In this case, the parameter set selector 203 selects the parameter set Y1 for the recording head H1, the parameter set Y3 for the recording head H2, and the parameter set Y5 for the recording head H3, respectively.

Figures 30A, 30B:
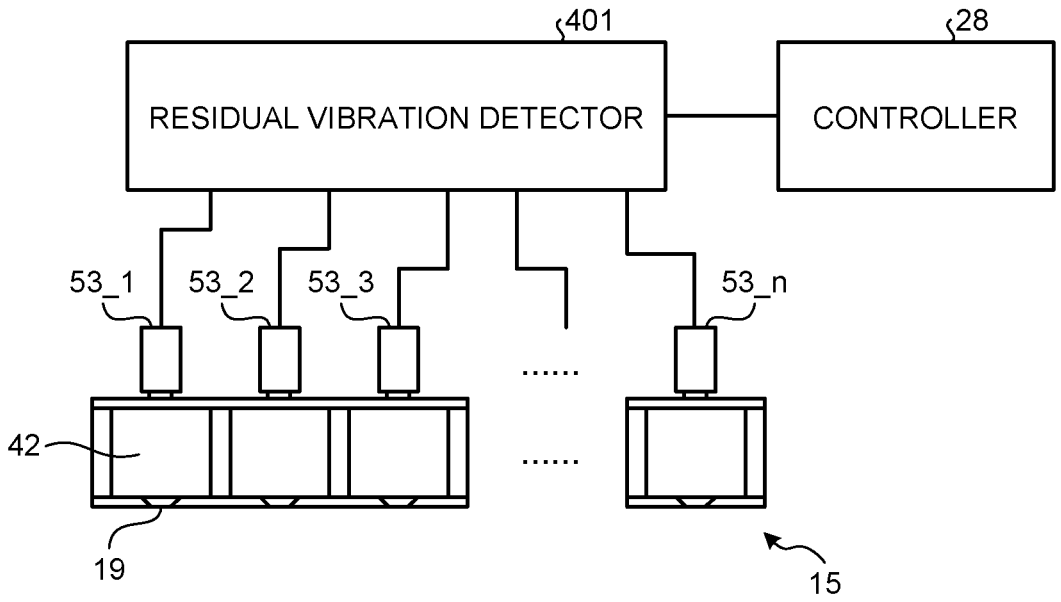
FIGS. 30A and 30B are diagrams illustrating a method for establishing an average value of the residual vibration waveforms output from a plurality of piezoelectric elements as an amplitude value of the recording head.

FIGS. 30A and 30B are diagrams illustrating a method for establishing the average value of the residual vibration waveforms output from a plurality of piezoelectric elements 53 as the amplitude value $V_{H1}$ of the recording head 15. FIG. 30A schematically illustrates a configuration for calculating an amplitude value Vc of the residual vibration waveform output from each of the n piezoelectric elements 53 of 53_1, 53_2, 53_3, . . . , and **53_*n* of the recording head 15. FIG. 30**B illustrates specific examples of the calculated amplitude values Vc and average value thereof.

When the n piezoelectric elements of 53_1, 53_2, 53_3, . . . , and **53_*n* of the recording head 15 have varying capacitance values, the amplitude values Vc_1, Vc_2, Vc_3, . . . , and Vc_n of the residual vibration waveforms output from the respective piezoelectric elements 53_1, 53_2, 53_3, . . . , and 53_*n* vary from each other. In the example illustrated in FIG. 30B, the amplitude values Vc_1, Vc_2, Vc_3, . . . , and Vc_n of the residual vibration waveforms of the piezoelectric elements 53_1, 53_2, 53_3, . . . , and 53_*n* are 100 mV, 400 mV, 300 mV, . . . , and 100 mV, respectively, and the average value of these amplitude values is 200 mV. Thus, 200 mV is established as the amplitude value $V_{Hx}$ of the recording head 15. When the average value of the outputs from the piezoelectric elements 53 of a recording head 15 is established as the amplitude value $V_{Hx}$ of the specific recording head 15, variations in the piezoelectric elements 53 of the recording head 15 can be absorbed to thereby adequately select a parameter set for the recording head 15**.

FIGS. 30A and 30B illustrate the method for establishing the average value of the outputs from the piezoelectric elements 53 in the recording head 15 as the amplitude value $V_{Hx}$ of the recording head 15. The output of a single piezoelectric element 53 may nonetheless be established as the amplitude value $V_{Hx}$ of the recording head 15. This approach enables detection of the residual vibration waveform within a short period of time, thus offering an advantage of reduction in the downtime of the image recording apparatus 1.

Exemplary embodiments of the present invention absorb not only variations in the ejection characteristics corresponding to the simultaneously driven nozzle count, but also difference in the ejection characteristics unique to each of a plurality of recording heads, so that degradation of image quality can be effectively prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image recording apparatus comprising:

a plurality of recording heads configured to be driven based on drive waveform data, each of the recording heads having unique ejection characteristics respectively;

a data storage configured to retain parameter sets corresponding to the unique ejection characteristics of the respective recording heads;

a simultaneously driven nozzle count detector configured to detect, for each of the recording heads, a simultaneously driven nozzle count that represents a quantity of nozzles to be driven at an identical drive timing based on image data to be recorded on a recording medium;

a correction parameter selector configured to select, for each of the recording heads, a correction parameter from among a plurality of correction parameters included in each of the parameter sets based on the detected simultaneously driven nozzle count; and a drive waveform data generator configured to generate the drive waveform data for each of the recording heads by correcting reference waveform data using the correction parameter selected for each of the recording heads.

2. The image recording apparatus according to claim 1, further comprising:

a parameter set selector configured to selects, from among a particular plurality of parameter sets, separate parameter sets corresponding to separate, respective recording heads of the plurality of recording heads, the parameter set selector further configured to store the separate parameter sets in the data storage.

3. The image recording apparatus according to claim 2, further comprising:

a test chart recording controller configured to cause the plurality of recording heads to eject ink onto the recording medium being conveyed using the separate parameter sets in sequence, while varying the simultaneously driven nozzle count, to record a test chart that includes a plurality of patterns corresponding to separate, respective parameter sets of the separate parameter sets; and a density detector configured to detect densities of the plurality of patterns included in the test chart, respectively;

wherein the parameter set selector is configured to select a parameter set corresponding to a particular pattern of the plurality of patterns, based on a determination that the particular pattern is associated with a minimum change in the densities of the plurality of patterns, with the simultaneously driven nozzle count varying, for each recording head of the plurality of recording heads as the parameter set corresponding to the recording head, respectively.

4. The image recording apparatus according to claim 2, further comprising:

a test chart recording controller configured to cause the plurality of recording heads to eject ink onto the recording medium being conveyed using the separate parameter sets in sequence, while varying the simultaneously driven nozzle count, to record a test chart that includes a plurality of patterns corresponding to separate, respective parameter sets of the separate parameter sets; and an input receiver configured to receives an operating input to specify a particular parameter set out of the separate parameter sets;

wherein the parameter set selector is configured to select, for each recording head of the plurality of recording heads, the particular parameter set specified by the operating input as the parameter set corresponding to the recording head, respectively.

5. The image recording apparatus according to claim 4, further comprising:

a controller connected to an apparatus main unit that includes the recording heads, the controller including the input receiver.

6. The image recording apparatus according to claim 2, further comprising:

a residual vibration detector configured to calculate, for each recording head of the plurality of recording heads, an amplitude value of a residual vibration waveform of the recording head driven using each parameter set of the separate parameter sets, respectively;

wherein the parameter set selector is configured to select the separate parameter sets corresponding to separate, respective recording heads so that a difference in the amplitude value of the residual vibration waveform between the recording heads is a minimum.

7. The image recording apparatus according to claim 6, wherein the parameter set selector is configured to use, as the amplitude value of the residual vibration waveform, an average value of amplitude values of the residual vibration waveforms output from a plurality of piezoelectric elements within each recording head of the plurality of recording heads.

8. The image recording apparatus according to claim 6, wherein the parameter set selector is configured to use, as the amplitude value of the residual vibration waveform, the amplitude value of the residual vibration waveforms output from one of piezoelectric elements within each recording head of the plurality of recording heads.

9. The image recording apparatus according to claim 1, further comprising:

a temperature detector configured to detect a temperature of at least one recording head of the plurality of recording heads;

wherein the correction parameter selector is configured to select, for each recording head of the plurality of recording heads, a correction parameter corresponding to the detected simultaneously driven nozzle count and the detected temperature from among the plurality of correction parameters included in the parameter set corresponding to the recording head, respectively.

10. The image recording apparatus according to claim 1, wherein the data storage includes a plurality of storages in the respective recording heads, and each storage of the plurality of storages is configured to retain the parameter set corresponding to the recording head in which the storage is included, respectively.

11. The image recording apparatus according to claim 1, wherein the image recording apparatus includes an apparatus main unit, and the apparatus main unit includes the plurality of recording heads;

the data storage is a single storage in the apparatus main unit; and the data storage is configured to retain all parameter sets corresponding to separate, respective recording heads of the plurality of recording heads.

12. The image recording apparatus according to claim 1, further comprising:

a plurality of drive control boards connected to separate, respective recording heads of the plurality of recording heads;

wherein the data storage includes a plurality of storages in separate, respective drive control boards of the plurality of drive control boards, and wherein each storage of the plurality of storages is included in a separate drive control board of the plurality of drive control boards and is configured to retain a parameter set corresponding to each recording heads connected to the separate drive control board.

13. The image recording apparatus according to claim 1, wherein the drive waveform data generator is configured to correct a voltage value of the reference waveform data based on the correction parameters selected for separate, respective recording heads of the plurality of recording heads.

14. The image recording apparatus according to claim 1, wherein the drive waveform data generator is configured to correct a rise time and a fall time of the reference waveform data based on the correction parameters selected for separate, respective recording heads of the plurality of recording heads.

15. A method performed in an image recording apparatus, the image recording apparatus including a plurality of recording heads configured to be driven based on drive waveform data, each of the recording heads having unique ejection characteristics respectively; and a data storage configured to retain parameter sets corresponding to the unique ejection characteristics of the respective recording heads, the method comprising:

detecting, for each of the recording heads, a simultaneously driven nozzle count that represents a quantity of nozzles to be driven at an identical drive timing based on image data to be recorded on a recording medium;

selecting, for each of the recording heads, a correction parameter from among a plurality of correction parameters included in each of the parameter set based on the detected simultaneously driven nozzle count; and correcting reference waveform data using the correction parameter selected for each of the recording heads to generate the drive waveform data for each of the recording heads.

16. The method of claim 15, further comprising:

select, from among a particular plurality of parameter sets, separate parameter sets corresponding to separate, respective recording heads of the plurality of recording heads; and storing the separate parameter sets in the data storage.

17. The method of claim 16, further comprising:

causing the plurality of recording heads to eject ink onto the recording medium being conveyed using the separate parameter sets in sequence, while varying the simultaneously driven nozzle count, to record a test chart that includes a plurality of patterns corresponding to separate, respective parameter sets of the separate parameter sets;

detecting densities of the plurality of patterns included in the test chart, respectively; and selecting a parameter set corresponding to a particular pattern of the plurality of patterns, based on a determination that the particular pattern is associated with a minimum change in densities of the plurality of patterns, with the simultaneously driven nozzle count varying, for each recording head of the plurality of recording heads as the parameter set corresponding to the recording head, respectively.

* * * * *